US007780272B2

(12) United States Patent
Hirota et al.

(10) Patent No.: US 7,780,272 B2
(45) Date of Patent: Aug. 24, 2010

(54) INKJET PRINTER

(75) Inventors: Atsushi Hirota, Nagoya (JP); Chitoshi Ueki, Kokubu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 890 days.

(21) Appl. No.: 11/382,862

(22) Filed: May 11, 2006

(65) Prior Publication Data

US 2006/0256163 A1 Nov. 16, 2006

(30) Foreign Application Priority Data

May 13, 2005 (JP) ..... 2005-140843

(51) Int. Cl.
*B41J 2/045* (2006.01)
*B41J 29/38* (2006.01)

(52) U.S. Cl. ..... 347/68; 347/10

(58) Field of Classification Search ..... 347/70, 347/72

See application file for complete search history.

(56) References Cited

U.S. PATENT DOCUMENTS

| | | | | |
|---|---|---|---|---|
| 5,291,248 | A | 3/1994 | Isobe | |
| 6,109,736 | A | 8/2000 | Miyata et al. | |
| 6,174,040 | B1 | 1/2001 | Hotomi | |
| 6,243,114 | B1 | 6/2001 | Yano et al. | |
| 6,447,106 | B1 | 9/2002 | Watanabe et al. | |
| 6,494,555 | B1 | 12/2002 | Ishikawa | |
| 6,557,986 | B2 | 5/2003 | Watanabe et al. | |
| 6,676,238 | B2 | 1/2004 | Fujimura et al. | |
| 7,537,300 | B2 | 5/2009 | Hirota | |
| 2004/0051763 | A1 | 3/2004 | Matsubara et al. | |
| 2004/0080585 | A1 * | 4/2004 | Iriguchi | 347/68 |
| 2004/0108790 | A1 | 6/2004 | Junhua et al. | |
| 2004/0246315 | A1 | 12/2004 | Takahashi | |

FOREIGN PATENT DOCUMENTS

JP 61144358 A * 7/1986

(Continued)

OTHER PUBLICATIONS

Hirota et al. U.S. Appl. No. 11/382,915, filed May 11, 2006.

(Continued)

*Primary Examiner*—Matthew Luu
*Assistant Examiner*—Lisa M Solomon
(74) *Attorney, Agent, or Firm*—Baker Botts L.L.P.

(57) ABSTRACT

The lnkjet printer has a pressure chamber, a plezoelectric actuator, and a controller. The plezoelectrlc actuator has a piezoelectric film, a first electrode, a second electrode, and a third electrode. The first electrode, positioned in the region facing the pressure chamber, and the third electrode, positioned adjacent to the first electrode, are attached on one surface of the piezoeiectric film. The second electrode is attached on an opposite surface of the piezoelectric film and overlaps the first and third electrodes. To discharge ink, the controller applies an ink discharge signal between the first and second electrodes comprising an advanced voltage change from a predetermined voltage to the lower voltage and a subsequent voltage change from the lower voltage to the predetermined voltage. The controller also applies a peripheral signal between the second and thIrd electrodes to prevent changes in characteristics of the piezoelectrlc actuator that may affect ink discharge.

12 Claims, 12 Drawing Sheets

FOREIGN PATENT DOCUMENTS

| | | | |
|---|---|---|---|
| JP | 04115951 A | * | 4/1992 |
| JP | H11 115184 | | 4/1999 |
| JP | 2004 128492 | | 4/2004 |

OTHER PUBLICATIONS

Hirota et al. U.S. Appl. No. 11/382,841, filed May 11, 2006.
Iwao, U.S. Appl. No. 11/288,415, filed Novemeber 29, 2005.
U.S. Patent and Trademark Office, Office Action in co-pending U.S. Appl. No. 11/382,841, Notification Date Apr. 3, 2008.
U.S. Patent and Trademark Office, Office Action in co-pending U.S. Appl. No. 11/382,915, Notification Date Jun. 1, 2009.
U.S. Patent and Trademark Office, Interview Summary in co-pending U.S. Appl. No. 11/382,915, Notification Date Jun. 1, 2009.

* cited by examiner ( a )

( b )

( a )

( b )

INKJET PRINTER

CROSS REFERENCE TO RELATED APPLICATION

This application claims priority to Japanese Patent Application No. 2005-140843 filed on May 13, 2005, the contents of which are hereby incorporated by reference into the present application.

BACKGROUND OF THE INVENTION

1. Field of the Invention

The present invention relates to an inkjet printer.

2. Description of the Related Art

An Inkjet printer having a pressure chamber, a piezoelectric actuator and a controller is known. The pressure chamber communicates with the nozzle.

The pressure chamber is filled with ink when the inkjet printer is used, and the piezoelectric actuator can apply pressure to the ink within the pressure chamber. When the ink within the pressure chamber is pushed by the piezoelectric actuator, ink is discharged from the nozzle. In this way, the indict printer will print text and/or image on a printing medium.

A conventional inkjet printer is disclosed in Japanese Patent Application Publication No. 2004-128492.

The piezoelectric actuator is arranged so as to form at least a portion of a wall defining the pressure chamber. The piezoelectric actuator has a piezoelectric film. The piezoelectric film extends along the portion of the wall, and has electrodes attached on both surfaces of the piezoelectric film.

By applying voltage difference between the electrodes, the piezoelectric film deforms due to the piezoelectric effect. As a result, the piezoelectric actuator deforms. Because the piezoelectric actuator forms a portion of the wall defining the pressure chamber, the volume of the pressure chamber changes due to the deformation of the piezoelectric actuator. By deforming the piezoelectric actuator so that the volume of the pressure chamber becomes smaller, pressure can be applied to the ink within the pressure chamber. By applying pressure to the ink within the pressure chamber, the ink will be discharged from the nozzle that communicates with the pressure chamber.

The so-called "fill before fire" method is often used in order to improve ink discharge efficiency by the piezoelectric actuator. In this method, the following operations are performed. According to "fill before fire" method, a predetermined voltage is applied to the piezoelectric film of the piezoelectric actuator prior to ink discharge operation. Due to the predetermined voltage, the piezoelectric film (i.e., the piezoelectric actuator) is deformed so that the volume of the pressure chamber becomes smaller. When the ink is to be discharged, an ink discharge signal is applied to the piezoelectric film. The ink discharge signal is composed of a combination of an advanced voltage change and a subsequent voltage change. In the advanced voltage change, voltage applied to the piezoelectric film is changed from the predetermined voltage that has been applied to the piezoelectric film to the lower voltage. Due to the advanced voltage change, deformation of the piezoelectric actuator is loosened, and the volume of the pressure chamber is increased. At the timing when the volume of the pressure chamber is increased, a negative pressure is generated within the pressure chamber. The generated pressure decrease develops a pressure wave within the pressure chamber. The developed pressure wave will propagate from the pressure chamber to the nozzle through an ink passage communicating the pressure chamber and the nozzle, and the pressure wave is reflected at the nozzle toward the pressure chamber. The reflected pressure wave will return to the pressure chamber. Due to reciprocation of the pressure wave, the pressure within the pressure chamber varies cyclically between a negative pressure and a positive pressure.

According to "fill before fire" method, the subsequent voltage change is applied to the piezoelectric film (i.e., the piezoelectric actuator) while the pressure wave continues. In the subsequent voltage change, voltage applied to the piezoelectric film is changed from the lower voltage that has been applied to the piezoelectric film to the predetermined voltage. Due to the subsequent voltage change, the piezoelectric actuator is deformed again, and the volume of the pressure chamber is decreased. According to "fill before fire" method, the subsequent voltage change is applied when positive pressure is developed within the pressure chamber due to the pressure wave generated by the advanced voltage change. In this method, the deformation of the piezoelectric actuator to decrease the volume of the pressure chamber and to increase the pressure within the pressure chamber occurs at timing when the pressure within the pressure chamber is increased to the positive value due to the pressure wave. Therefore, a large positive pressure is developed within the pressure chamber by the subsequent voltage change, and ink is effectively discharged from the nozzle. High discharge efficiency may be obtained by "fill before fire" method. The time period from the advanced voltage change to the subsequent voltage change is critical to obtain high ink discharge efficiency.

BRIEF SUMMARY OF THE INVENTION

With the "fill before fire" method, during the period in which ink is not discharged from the nozzle, the predetermined voltage is continuously applied to the piezoelectric film. As a result, during the period in which ink is not discharged from the nozzle, a region of the piezoelectric actuator, the region facing the pressure chamber, is kept in a fixed deformed state. The period in which ink is not discharged is referred to as a non-discharge period.

With conventional technology, the fixed deformed state of the piezoelectric actuator is only loosened during the lower voltage is applied by applied ink discharge signal. The length of the non-discharge period depends on the images to be printed. Thus, depending on the situation, the length of non-discharge period may be prolonged.

On the other hand, a period in which the lower voltage is applied to the piezoelectric film is shorter than the non-discharge period. In other words, the piezoelectric actuator repeats longer fixed deformed state and shorter loosened deformed state alternatively.

A pair of electrodes attached respectively on each surface of the piezoelectric film. At least one electrode of the pair of electrodes is positioned so as to apply voltage to the piezoelectric film in the region facing the corresponding pressure chamber. If a voltage is applied to the pair of electrodes, the region of the piezoelectric film sandwiched by the pair of the electrodes deforms, but a peripheral region of the above mentioned region is not deformed. The region of the piezoelectric film that is sandwiched by the pair of electrodes and deformed when voltage is applied is referred to as an active portion. The peripheral region of the piezoelectric film that is not deformed even when voltage is applied to the electrodes is referred as a peripheral portion.

A fixed stress arises at the boundary of the active portion and peripheral portion when the active portion is in the fixed deformed state. As described above, the active portion is maintained in the fixed deformed state over the non-discharge period. The stress at the boundary is also kept over the non-discharge period. The fixed stress is eased when the lower voltage is applied to the active portion. As described above, the period applied the lower voltage is shorter than the non-discharge period. At the boundary, the active portion and the peripheral portion suffer the fixed stress for longer period and eased stress for shorter period alternatively.

According to researches performed by the inventors, it was discovered that the ink discharge characteristics may change remarkably if the piezoelectric film suffers fixed stress for longer period and eased stress for shorter period cyclically at the boundary for a long period of time.

The polarization structure of the piezoelectric material may change when the piezoelectric material suffers stress for a long time. A polarization structure will be held as is once changed, and does not return to the original state. When the polarization structure changes and is held, a strain will occur and be maintained.

It was discovered by the inventors, that a change in the polarization structure in the piezoelectric film is remarkably developed close to the boundary of the active portion and peripheral portion of the piezoelectric film if the piezoelectric film suffers the fixed stress for longer period and the eased stress for shorter period cyclically at the boundary for a long period of time.

The polarization structure of the peripheral portion at the boundary changes, the peripheral portion will have a strain. Because of the strain at the peripheral portion, the characteristic of the piezoelectric film at the active portion will change. The characteristic, as referred to herein, is the relationship between the level of voltage applied to the piezoelectric film (i.e., the piezoelectric actuator) and the deformation of the piezoelectric actuator induced thereby.

Furthermore, the strain at the peripheral portion causes another fixed stress to the active portion. The characteristic of the piezoelectric film at the active portion also changes due to another fixed stress. The characteristic of the piezoelectric film at the active portion remarkably changes due to both of another fixed stress and the strain. Therefore, the ink discharge characteristics will change remarkably due to remarkable change of the characteristic of the piezoelectric film.

The characteristic change of the piezoelectric actuator affects such that the piezoelectric actuator becomes difficult to deform. If the piezoelectric actuator becomes difficult to deform, the quantity of discharged ink and/or the discharge rate, will decrease. The ink discharge characteristics will change so as to decrease the quantity of discharged ink and/or the discharge rate if the piezoelectric actuator repeats longer fixed deformed state and shorter loosened deformed state alternatively for a long period of time.

An object of the present invention is to provide an inkjet printer in which the ink discharge characteristics will rarely change, even if the inkjet printer is used for a long period of time.

An inkjet printer according to the present invention has a pressure chamber, a piezoelectric actuator, and a controller. The pressure chamber communicates with a nozzle. The pressure chamber is capable of being filled with ink when the inkjet printer is used. The piezoelectric actuator has a piezoelectric film, a first electrode, a second electrode, and a third electrode. The controller applies voltage between the first electrode and the second electrode and between the third electrode and the second electrode independently.

The piezoelectric actuator forms a portion of a wall defining the pressure chamber. The piezoelectric film of the piezoelectric actuator extends along the portion of the wall.

The first electrode is attached on one surface of the piezoelectric film within a region overlapping with the portion of the wall. Herein, the first electrode and the portion of the wall overlap in a direction perpendicular to the plane of the portion of the wall. The second electrode is attached on the other surface of the piezoelectric film extending over a region overlapping with the first electrode. The first electrode and the second electrode overlap in the direction mentioned above. The third electrode is attached on the one surface of the piezoelectric film, adjacent to the first electrode without contacting the first electrode, at a region overlapping with a portion of the second electrode. The second electrode and the third electrode overlap in the direction mentioned above.

The piezoelectric actuator deforms so as to project toward the pressure chamber and to decrease a volume of the pressure chamber while the controller applies voltage between the first electrode and the second electrode.

The controller applies an ink discharge signal between the first electrode and the second electrode, the ink discharge signal comprising an advanced voltage change from a predetermined voltage to a lower voltage and a subsequent voltage change from the lower voltage to the predetermined voltage wherein the combination of the volume increase and the subsequent volume decrease of the pressure chamber due to the ink discharge signal causes ink to discharge from the nozzle. The controller also applies a peripheral signal between the second electrode and the third electrode.

The inkjet printer may have a plurality of pressure chambers and nozzles. When an inkjet printer has a plurality of pressure chambers, the inkjet printer has the first electrodes equal in number to the pressure chambers.

In the above-described inkjet printer, the first electrode is positioned on the piezoelectric film within a region overlapping with the wall defining the pressure chamber. The region of the piezoelectric film sandwiched by the first electrode and the second electrode is equivalent to the above-described active portion.

The third electrode is attached on the piezoelectric film adjacent to the first electrode without contacting the first electrode. The region of the piezoelectric film sandwiched by the second electrode and the third electrode is a part of the above-described peripheral portion.

The controller can apply voltage to the peripheral portion by applying the peripheral signal between the second electrode and the third electrode. The conventional inkjet printer did not apply voltage to the peripheral portion of the piezoelectric actuator.

The controller can reduce the characteristic change of the piezoelectric actuator by applying the peripheral signal between the second electrode and the third electrode. As a result, the inkjet printer in which the ink discharge characteristics will rarely change, even if the inkjet printer is used for a long period of time. The reason of reducing the characteristic change of the piezoelectric film is explained below.

When voltage is applied between the first electrode and the second electrode, the active portion of the piezoelectric film extends in the thickness direction due to a piezoelectric effect. At the same time, the active portion shrinks in the planar direction. As a result, the peripheral portion adjacent to the active portion receives tensile stress in the planar direction. If such tensile stress is continuously suffered over a long period of time, the distribution state of the polarization direction of crystal grain units in the piezoelectric film changes in the peripheral portion. The change of distribution state of polarization directions causes micro-structural change in the peripheral portion. In this case, such micro-structural change causes the peripheral portion to have a strain so as to extend the peripheral portion toward the active portion.

If the peripheral portion extends toward the active portion, the peripheral portion provides compressive stress to the active portion adjacent thereto. As a result, the distribution state of the polarization direction of crystal grain units in the active portion changes. Thus, the characteristic of the piezoelectric film changes. The characteristic change of the piezoelectric film means the characteristic change of the piezoelectric actuator.

In accordance with the present invention, the controller applies voltage to the peripheral portion by applying peripheral signal between the second electrode and the third electrode. The voltage applied to the peripheral portion work so as to return the distribution state of the polarization direction from changed state to its original state. Therefore, extension of the peripheral portion caused by change of the distribution state. As a result, the characteristic change of the piezoelectric film can be prevented. The ink discharge characteristic change can be prevented. An inkjet printer in which the ink discharge characteristic does not change even in a long-term use can be realized.

BRIEF DESCRIPTION OF THE DRAWINGS

FIG. 9(*b*) illustrates a change of electric potential of individual electrodes when the ink discharge signal shown in FIG. 9(*a*) is applied.

DETAILED DESCRIPTION OF THE INVENTION

Figure 1:
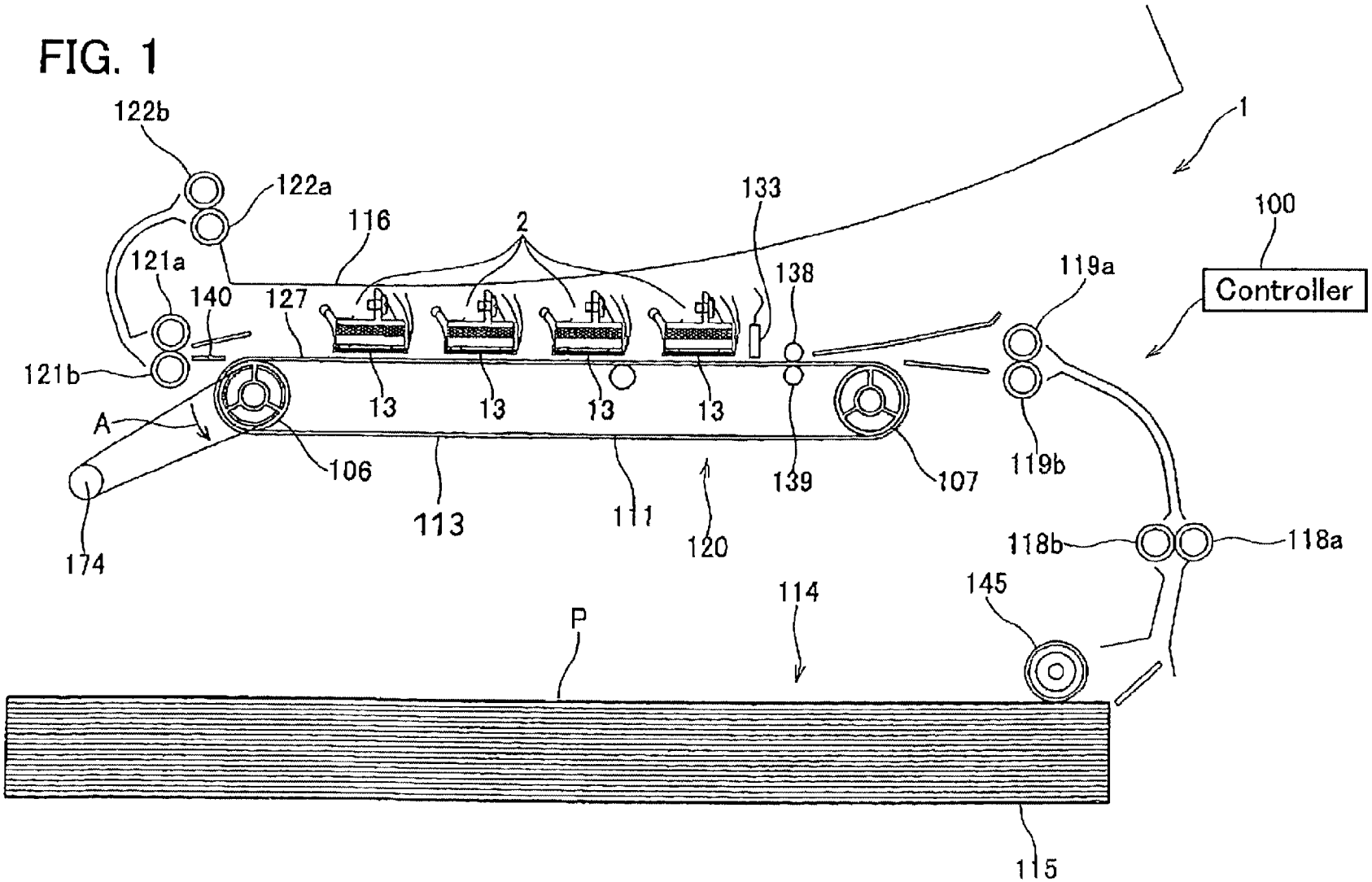
FIG. 1 is a schematic drawing of an inkjet printer of an embodiment.

Preferred technical features of the present invention are described below.

The piezoelectric actuator may have a diaphragm. The diaphragm may sandwich the second electrode with the piezoelectric film and the diaphragm may be positioned between the piezoelectric film and the pressure chamber.

According to the aforementioned technical feature, the diaphragm forms the portion of the wall defining the pressure chamber. It can prevent the second electrode to directly contact with ink in the pressure chamber.

The lower voltage in the ink discharge signal applied by the controller may be substantially equal to zero voltage.

If the lower voltage is set to zero voltage, the active portion is temporarily released from deformation during the ink discharge operation. The boundary of the active portion and peripheral portion is repeatedly released from stress which is caused in the non-discharge period. If such a state is maintained without applying the peripheral signal, the characteristic change of the piezoelectric film (i.e., the piezoelectric actuator) would become even more significant at the boundary of the active portion and the peripheral portion. Even in this case, the controller can prevent the characteristic change of the piezoelectric film, as described above, by the application of the peripheral signal between the third electrode and the second electrode.

The controller generates the predetermined voltage during applying the ink discharge signal between the first electrode and the second electrode. The controller may apply the predetermined voltage between the second electrode and the third electrode as the peripheral signal. The controller may apply same voltage both of in the ink discharge signal and in the peripheral signal. The structure or the circuit of the controller can be simplified.

The controller may apply the peripheral signal in an interval of the two sequential ink discharge signals.

According to the aforementioned technical feature, voltage is not applied to the peripheral portion during the ink discharge operation. The voltage applied to the peripheral portion can be prevented from affecting the ink discharge operation.

The controller may apply the peripheral signal within a period that the ink discharge signal is applied. In this case, the peripheral signal has a waveform so as to enhance efficiency of the volume change of the pressure chamber caused by the ink discharge signal.

Depending on the intensity and/or applying timing of voltage in the peripheral signal, stresses that enhance the ink discharge operation may be applied to the active portion due to the applying peripheral signal. By forming a waveform of the peripheral signal that produces such an effect, the ink discharge operation can be performed more effectively.

Furthermore, because the peripheral signal is applied even in the ink discharge operation, the characteristic change of the piezoelectric film can be effectively prevented.

One continuous piezoelectric film may extend over the pressure chamber.

According to the aforementioned technical feature, the entire wall at a side of the pressure chamber can be covered with the piezoelectric film. It can efficiently change the volume of the pressure chamber.

The third electrode may have a hole, and the first electrode may be positioned within the hole.

According to the aforementioned technical feature, a structure can be easily obtained in which the peripheral portion around the first electrode is surrounded by the third electrode. A voltage can be uniformly applied to the peripheral portion around the first electrode. The characteristic change of the piezoelectric film around the active portion can be uniformly prevented.

Furthermore, because a hole may be formed in the third electrode the process for manufacturing the inkjet printer can be facilitated.

Providing a plurality of holes in the third electrode makes it possible to surround the peripheral portion around a plurality of first electrodes with a single third electrode.

The first electrode and the third electrode may have substantially the same thickness.

According to the aforementioned technical feature, because the first electrode and the third electrode have the same thickness, the process for manufacturing the electrodes can be further simplified.

The controller may apply a constant voltage between the second electrode and the third electrode as the peripheral signal.

According to the aforementioned technical feature, the controller can be configured in a simple manner.

The second electrode may be held at a constant electric potential.

According to the aforementioned technical feature, the controller is not required to change the electric potential of the second electrode. Because the controller may apply the respective signals to the first electrode and third electrode, the structure or the circuit of the controller can be simplified.

The peripheral signal may have a waveform repeating the predetermined voltage and zero voltage cyclically.

According to the aforementioned technical feature, the predetermined voltage is applied to the peripheral portion cyclically. The characteristic change of the piezoelectric film can be effectively prevented by repeatedly applying the predetermined voltage to the peripheral portion.

The inkjet printer may have a counter counting a count of matching a predetermined condition. In this case, the controller may apply the peripheral signal when the count reaches a predetermined number.

The predetermined condition is, for example, a condition of ink being discharged. The counter may be a device for measuring the time that elapsed since the printer was first used. In this case, the count means the time that elapsed since the printer was first used.

According to the aforementioned technical feature, the characteristic change of the piezoelectric film can be effectively prevented, without applying unnecessary voltage between the second electrode and the third electrode, by adjusting the timing at which the count reaches the predetermined count to the timing suitable for preventing the characteristic change of the piezoelectric film.

Preferred embodiments of the present invention will be described with reference to the attached drawings.

<Outline of the Inkjet Printer>

FIG. 1 is a schematic view of a color inkjet printer according to an embodiment of the present invention. This color inkjet printer 1 (hereinafter referred to as a printer 1) has four inkjet heads 2. These inkjet heads 2 are fixed to the printer 1. These inkjet heads 2 are arranged along the direction in which a printing sheet P is conveyed. Each inkjet head 2 has a long shape that extends from the front of FIG. 1 to the rear thereof.

A paper supply unit 114, a paper receiving section 116, and a conveying unit 120 are provided in the printer 1. In addition, a controller 100 is provided in the printer 1 in order to control the operation of each portion of the printer 1, such as the inkjet heads 2 and the paper supply unit 114.

The paper supply unit 114 has a paper storage case 115 that can store a plurality of printing sheets P, and a paper supply roller 145. The paper supply roller 145 can feed the uppermost printing sheet P of the printing sheets that are stacked and stored in the paper storage case 115, one sheet at a time.

A pair of feed rollers 118*a* and 118*b*, and a pair of feed rollers 119*a* and 119*b*, are arranged between the paper supply unit 114 and the conveying unit 120, and along the conveyance path of the printing sheets P. The printing sheet P fed from the paper supply unit 114 is further fed toward the conveying unit 120 by means of these feed rollers.

The conveying unit 120 has an endless conveyor belt 111, and two belt rollers 106 and 107. The conveyor belt 111 is wrapped around the belt rollers 106 and 107. The conveyor belt 111 is adjusted so that a predetermined tension is applied thereto when wrapped around the two belt rollers. In this way, the conveyor belt 111 is stretched between the two belt rollers 106 and 107 without any slack. The surface of the conveyor belt 111 near the inkjet head 2 is a conveying surface 127 that conveys the printing paper P.

As shown in FIG. 1, a conveying motor 174 is connected to the belt roller 106. The conveying motor 174 can rotate the belt roller 106 in the direction of the arrow A. In addition, the belt roller 107 can rotate in association with the conveyor belt 11. Thus, by driving the conveying motor 174 in order to rotate the belt roller 106, the conveyor belt 111 will rotate in the direction of the arrow A.

A nip roller 138 and a nip receiving roller 139 are arranged near the belt roller 107 so as to sandwich the conveyor belt 111. The nip roller 138 is urged downward by a spring not shown in the drawings. The nip receiving roller 139 below the nip roller 138 stops the nip roller 138 that is urged downward via the conveyor belt 111. The nip roller 138 and the nip receiving roller 139 are rotatably disposed, and rotate in association with the rotation of the conveyor belt 111.

Printing paper P fed from the paper supply unit 111 toward the conveying unit 120 is grasped between the nip roller 138 and the conveyor belt 111. In this way, the printing paper P is pressed onto the conveying surface 127 of the conveyor belt 111, and fixed on the conveying surface 127. Then, the printing paper P is conveyed in the direction in which the inkjet heads 2 are disposed, in accordance with the rotation of the conveyor belt 111. Note that the outer peripheral surface 113 of the conveyor belt 111 may be treated with an adhesive silicone rubber. In this way, the printing paper P can be reliably fixed to the conveying surface 127.

The four inkjet heads 2 are arranged near each other along the direction in which the printing paper P is conveyed by the conveyor belt 111. Each inkjet head 2 has a head main body 13 on the lower edge thereof. A large number of nozzles 8 (not shown in FIG. 1) that discharge ink are provided in the lower surface of the head main body 13. The same color of ink will be discharged from the nozzles 8 provided on one ink jet head 2. The colors of the ink discharged from each inkjet head 2 are, respectively, magenta (M), yellow (Y), cyan (C), and black (K). Each inkjet head 2 is arranged so that there is a slight gap between the lower surface of the head main body 13 and the conveying surface 127 of the conveyor belt 111.

A printing sheet P fixed to the conveying surface 127 of the conveyor belt 111 will pass between the inkjet head 2 and the conveyor belt 111. When this occurs, ink will be discharged from the nozzles 8 of the head main body 13 toward the upper surface of the printing sheet P. In this way, a color image based on image data stored by the controller 100 (see FIG. 6) will be printed on the upper surface of the printing sheet P.

A peel plate 140 and two pairs of feed rollers 121*a* and 121*b*, and 122*a* and 122*b*, are arranged between the conveying unit 120 and the paper receiving section 116. The printing paper P on which a color image has been printed is conveyed toward the peel plate 140 by the conveyor belt 111. At this point, the printing paper P is peeled from the conveying surface 127 by the right side of the peel plate 140 in FIG. 1. Then, the printing paper P is fed to the paper receiving section 116 by the feed rollers 121*a*-122*b*. Thus, printing papers P on which images have been printed will be sent to the paper receiving section 116. These printing papers P will be stacked onto the paper receiving section 116.

Note that a paper sensor 133 is disposed between the inkjet head 2 on the furthest upstream side in the direction in which the printing papers P are conveyed, and the nip roller 138. The paper sensor 133 is constructed from a light emitting element and a light receiving element. The paper sensor 133 will detect the leading edge of a printing sheet P in the conveying passage. The detection results are transmitted from the paper sensor 133 to the controller 100. The controller 100 will control the inkjet head 2, the conveying motor 174, and the like so that the conveyance of the printing paper P and the printing of the images are synchronized, based upon the detection signal transmitted from the paper sensor 133.

<Head Main Body>

Figure 2:
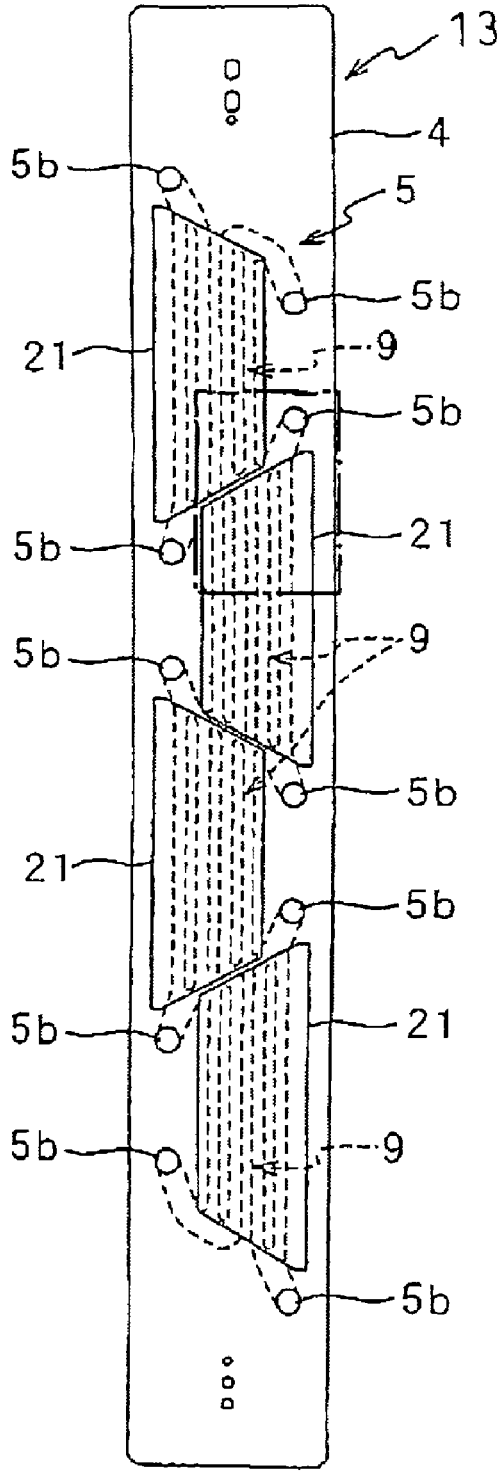
FIG. 2 is a plan view of a head main body shown in FIG. 1.

The head main body 13 will be described. FIG. 2 is a plan view of the bead main body 13 shown in FIG. 1 when viewed from the upper surface thereof.

The head main body 13 has a passage unit 4, and actuator units 21 that are adhered to the passage unit 4. Each actuator unit 21 has a trapezoidal shape. The actuator units 21 are arranged on the upper surface of the passage unit 4 so that the pair of opposing parallel sides of each trapezoid is parallel with the lengthwise direction of the passage unit 4. In addition, four actuator units 21 are arranged on the upper surface of the passage unit 4 along the lengthwise direction of the passage unit. The adjacent actuator units 21 are arranged so that the trapezoids are arranged to face in opposite directions along the width of the passage unit 4. In addition, the adjacent actuator units 21 are arranged to be relatively offset along the width of the passage unit 4. A diagonal side of one trapezoid and adjacent diagonal side of the trapezoid adjacent to the one trapezoid partially overlap along the width of the passage unit.

A manifold passage 5 that is a portion of the ink passage is formed in the interior of the passage unit 4. Openings 5*b* of the manifold passage 5 are formed on the upper surface of the passage unit 4. Five openings 5*b* are arranged along one edge of the passage unit 4 in the lengthwise direction. Another five openings 5*b* are arranged along another edge of the passage unit 4 in the lengthwise direction. In the plan view of FIG. 2, the openings 5*b* are formed in positions outside the regions in which the four actuator units 21 are arranged. Ink is supplied from an ink tank not shown in the drawings, through the openings 5*b*, to the manifold passage 5.

Figure 3:
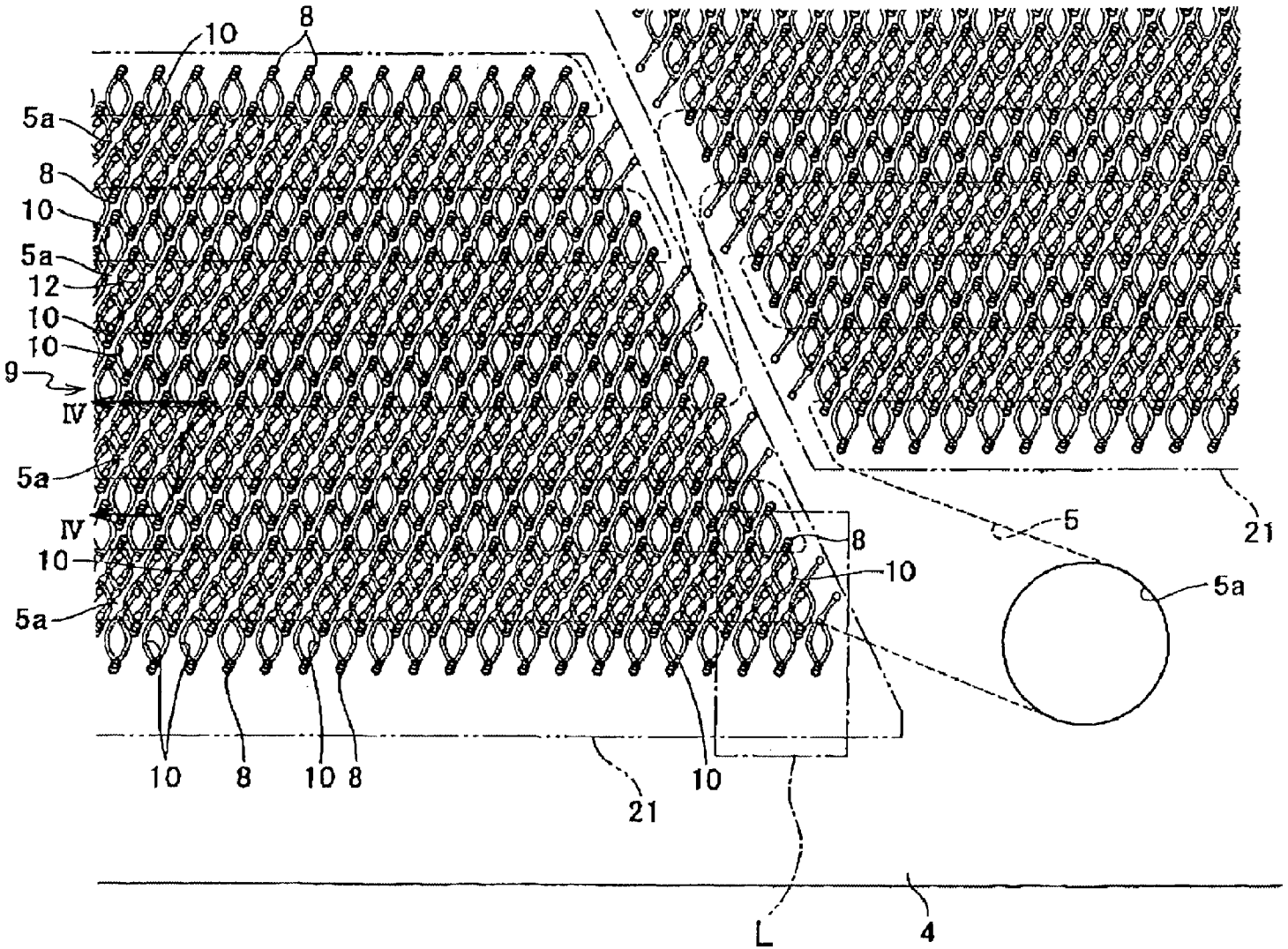
FIG. 3 is an enlarged view of the region that is surrounded by the thick broken line in FIG. 2.

FIG. 3 is an enlarged plan view of the region surrounded by the thick broken line of FIG. 2. Note that illustration of the actuator units 21 is omitted in FIG. 3 in order to make FIG. 3 easier to understand. In other words, FIG. 3 is a plan view of the head main unit 13 in a state in which the actuator units 21 are not arranged on the upper surface of the passage unit 4. In addition, the components formed in the interior and lower surface of the passage unit 4, such as apertures 12 and nozzles 8, should be shown with broken lines in FIG. 3, but are shown with solid lines therein.

A plurality of sub-manifold passages 5*a* branch from the manifold passage 5 formed inside the passage unit 4. These sub-manifold passages 5*a* extend inside the passage unit 4 so as to be mutually adjacent with the regions that are opposite each actuator unit 21.

The passage unit 4 has pressure chamber groups 9 in which the pressure chambers 10 are formed in a lattice pattern. The pressure chambers 10 are hollow regions having a flat rhomboid shape in which the corners are rounded. The pressure chambers 10 are formed so as to open on the upper surface of the passage unit 4. These pressure chambers 10 are arranged along substantially the entire surface of the region that faces the actuator units 21 on the upper surface of the passage unit 4. In other words, the plurality of pressure chambers 10 are covered by the actuator units 21 on the upper surface of the passage unit 4. Each pressure chamber group 9 that are formed by these pressure chambers 10 have substantially the same size and shape as an actuator unit 21 in the direction perpendicular to the top surface of the passage unit 4.

A large number of nozzles 8 are formed on the lower surface of the passage unit 4. These nozzles 8 are arranged in positions that avoid the sub-manifold passages 5*a* in the plan view of FIG. 3. In addition, these nozzles 8 are arranged in regions that face the actuator units 21 in the plan view of FIG. 3. The nozzles 8 in each respective region are aligned in parallel lines in the lengthwise direction of the passage unit 4 with equal intervals.

The plurality of nozzles 8 are arranged as described below. Here, it will be assumed that there is an imaginary straight line that is parallel with the lengthwise direction of the passage unit 4. Projection points that project from every nozzle 8 along a direction perpendicular with the imaginary straight line toward the imaginary straight line are aligned with uniform, uninterrupted intervals. The interval corresponds to the print resolution. By arranging the nozzles 8 in this manner, the inkjet head 2 can print in uninterrupted intervals corresponding to the print resolution, along substantially the entire region in which the nozzles 8 are formed on the passage unit 4 in the lengthwise direction.

A large number of apertures (choke) 12 are formed in the interior of the passage unit 4. The apertures 12 are disposed in a region that faces the pressure chamber groups 9 in the plan view of FIG. 3. In the present embodiment, the apertures 12 extend along one direction that is parallel with the horizontal plane (the plane that is parallel with the plan view in FIG. 3).

Communication holes are formed in the interior of the passage unit 4. The communication holes are formed in order to mutually communicate with pressure chamber 10, the apertures 12 corresponding to the pressure chamber 10, and the nozzles 8 corresponding to the pressure chamber 10. These communication holes communicate with each other, and form the individual ink passages 32 (see FIG. 4). Each individual ink passage 32 communicates with the sub-manifold passages 5*a* at one end thereof. Ink supplied to the manifold passage 5 passes through the sub-manifold passages 5*a*, is branched to each individual ink passage 32, and is discharged from the nozzles 8.

<Individual Ink Passages>

Figure 4:
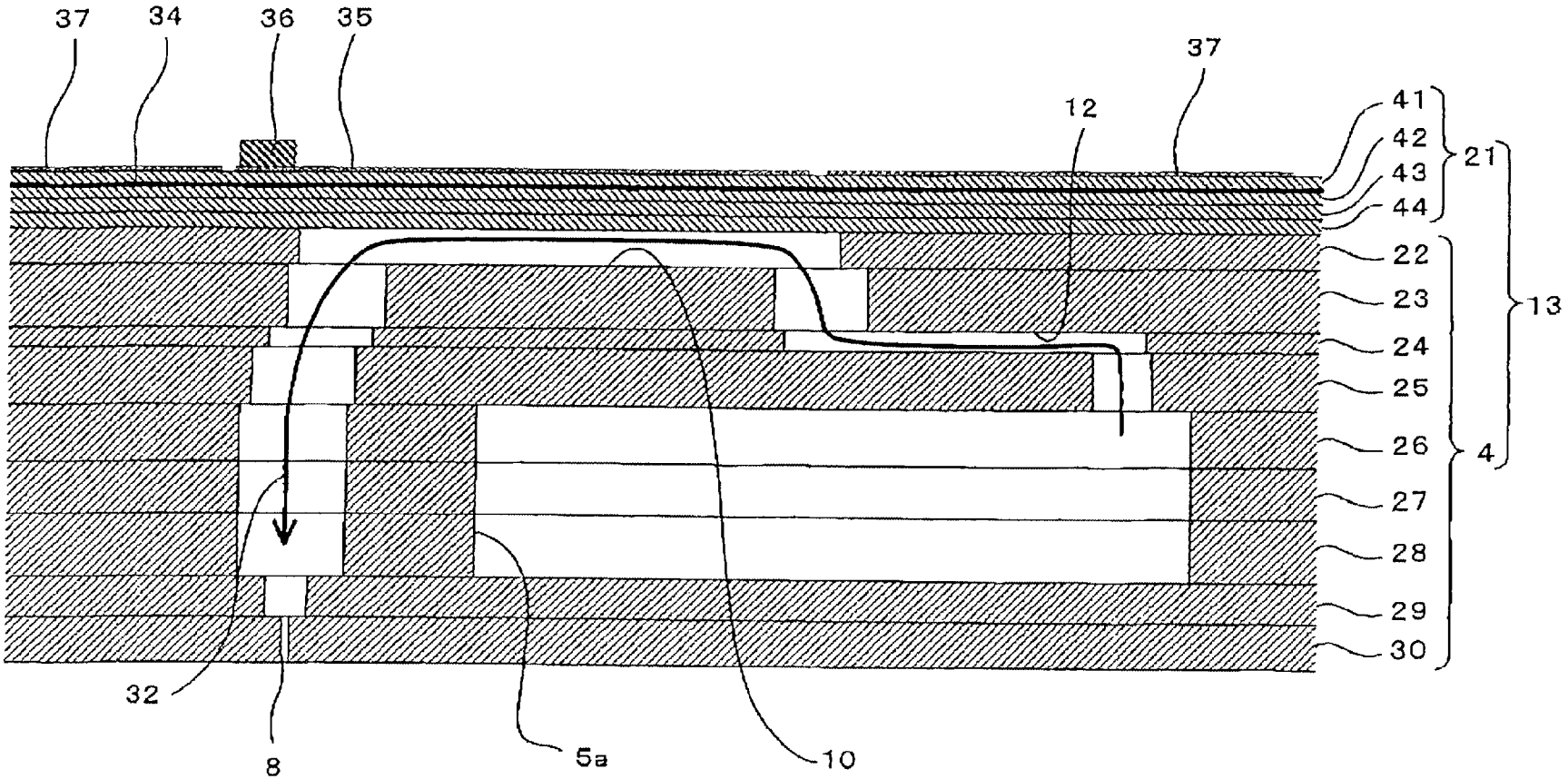
FIG. 4 is a longitudinal sectional view corresponding to line IV-IV shown in FIG. 3.

The individual ink passages 32 will be described with regard to the cross-sectional structure of the head main unit 13. FIG. 4 is a vertical cross-sectional view corresponding to line IV-IV shown in FIG. 3.

The passage unit 4 that is included in the head main unit 13 has a laminated structure in which a plurality of plates are laminated. These plates are, from the upper surface of the passage unit 4, a cavity plate 22, a base plate 23, an aperture plate 24, a supply plate 25, manifold plates 26, 27, 28, a cover plate 29, and a nozzle plate 30. A large number of communication holes are formed in these plates. When each plate is laminated, the communication holes formed in each plate communicate with each other so as to form the individual ink passages 32 and the sub-manifold passages 5*a*. In other words, each plate is positioned and laminated so that the individual ink passages 32 and the sub-manifold passages 5*a* are formed by means of the communication holes.

The communication holes formed in each plate will be described. The following elements are in these communication holes.

First, the pressure chambers 10 formed in the cavity plate 22.

Second, a communication hole group A that forms a passage that communicates from one end of the pressure chamber 10 to the sub-manifold passage 5*a*. The communication hole group A is formed in each plate from the base plate 23 to the supply plate 25. Note that the aperture 12 formed in the aperture plate 24 is included in the communication hole group A.

Third, a communication hole group B that forms a passage that communicates from the other end of the pressure chamber 10 to the nozzle 8. The communication hole group B is formed in each plate from the base plate 23 to the cover plate 29.

Fourth, the nozzle 8 formed in the nozzle plate 30.

Fifth, a communication hole group C that forms the sub-manifold passage 5*a*. The communication hole group C is formed in the manifold plates 26-28.

The individual ink passages 32 are formed due to the mutual communication of the communication holes. Ink supplied to the sub-manifold passage 5*a* will flow to the nozzle 8 through the individual ink passage 32 by following way. The ink will flow upward from the sub-manifold passage 5*a* to one end of the aperture 12. Next, the ink will flow horizontally along the lengthwise direction of the aperture 12 to the other end of the aperture 12. The ink will flow upward from the other end of the aperture 12 to one end of the pressure chamber 10. Furthermore, the ink will flow horizontally along the lengthwise direction of the pressure chamber 10 to the other end of the pressure chamber 10. The ink will flow from the other end of the pressure chamber 10 diagonally downward through the ink passage 32 that passes through three plates (the base plate 23, the aperture plate 24, and the supply plate 25). The ink will then flow to the nozzle 8 formed in the nozzle plate 30, via the ink passage 32 that passes through four plates (the manifold plates 26-28, and the cover plate 29).

<Actuator Units>

The actuator unit 21, as shown in FIG. 4, has a laminated structure in which one piezoelectric film 41 and three diaphragms 42, 43, 44 are laminated together. The piezoelectric film 41 and diaphragms 42-44 each have a thickness of about 15 μm. The overall thickness of the actuator unit 21 is about 60 μm. Each of the piezoelectric film 41 and diaphragms 42-44 extends so as to cover a plurality of pressure chambers 10 (see FIG. 3). Thus, as shown in FIG. 4, the actuator unit 21 forms a portion of the wall defining the pressure chamber.

As shown in FIG. 4, the piezoelectric film 41 extends along the upper surface of the passage unit 4. In other words, the piezoelectric film 41 extends along the portion of the wall. By this configuration, when the actuator unit 21 bends by the piezoelectric effect, the region of the actuator unit 21 facing the pressure chamber 10 deforms so as to project toward the pressure chamber 10.

The piezoelectric film 41 is produced from a lead titanate zirconate (PST) type of ceramic material which has ferroelectric properties. Other ceramic materials or metal materials may be used for the material of the diaphragms 42-44, or PZT identical to that of the piezoelectric film 41 may be used. Alternatively, a piezoelectric material other than PZT may be used. For example, lead magnesium niobate, lead nickel niobate, lead zinc niobate, lead manganese niobate, lead antimony stannate, and lead titanate can be used as the materials analogous to PZT. Those materials have high mutual affinity, and when those materials are used, endurance of the actuator unit 21 can be increased.

<Electrodes>

The actuator unit 21 has electrodes of three types comprising a metal material such as an Ag—Pd system. Those electrodes are an individual electrode 35 (first electrode), a common electrode 34 (second electrode) and a peripheral electrode 37 (third electrode).

The individual electrode 35 is arranged in a position opposite the pressure chamber 10 on the upper surface of the piezoelectric film 41. In other words, the individual electrode 35 is positioned within a region overlapping the wall defining the pressure chamber 10 in a direction perpendicular to the wall of the pressure chamber 10. The wall is formed by the actuator unit 21.

A land 36 is formed on one end of the individual electrode 35. The land 36 comprises, for example, gold containing a glass frit. The land 36 is formed to have a convex shape with a thickness of about 15 μm on the upper surface of the individual electrode 35. Furthermore, the land 36 is electrically joined to a contact (not shown in the drawings) provided on a FPC (Flexible Printed Circuit) not shown in FIG. 4. As described hereinbelow, the controller 100 can transmit various electrical signals (voltage pulse signals) via the FPC to the individual electrode 35.

The common electrode 34 is placed between the piezoelectric film 41 and the diaphragm 42 over almost the entire contact surface. Thus, the common electrode 34 extends so as to cover the entire pressure chamber 10 facing the actuator unit 21. The thickness of the common electrode 34 is about 2 μm. The common electrode 34 is grounded in a region that is not shown in the figure, and is kept at ground potential.

As shown in FIG. 4, the individual electrode 35 and common electrode 34 are positioned to sandwich only the uppermost piezoelectric film 41. The region in the piezoelectric film 41 that are sandwiched between the individual electrode 35 and the common electrode 34 will be referred to as an active portion. In the present embodiment, the active portion is the region of the piezoelectric film 41 to which a voltage is applied by the individual electrode 35 and the common electrode 34. If voltage is applied, the active portion is deformed due to a piezoelectric effect. In the actuator unit 21 of the present embodiment, only the uppermost piezoelectric film 41 comprises the active portion, and the diaphragms 42-44 do not have the active portion. Thus, this actuator unit 21 has the so-called unimorph-type structure.

The peripheral electrode 37 is arranged on the upper surface of the piezoelectric film 41. The peripheral electrode 37 has a thickness equal to the thickness of the individual electrode 35.

The peripheral electrode 37 is positioned without electric contact with the individual electrode 35 on the upper surface of the piezoelectric film 41 in the region (the region that does not face the pressure chamber 10) where the individual electrode 35 is not positioned. The peripheral electrode 37 has a contour surrounding the outer periphery of the individual electrode 35 on the upper surface of the piezoelectric film 41. Therefore, the peripheral electrode 37 together with the common electrode 34 sandwich the region outside the active portion of the piezoelectric film 41. The region sandwiched by the common electrode 34 and the peripheral electrodes 37 in the piezoelectric film 41 will be referred to as a peripheral portion.

Figure 5:
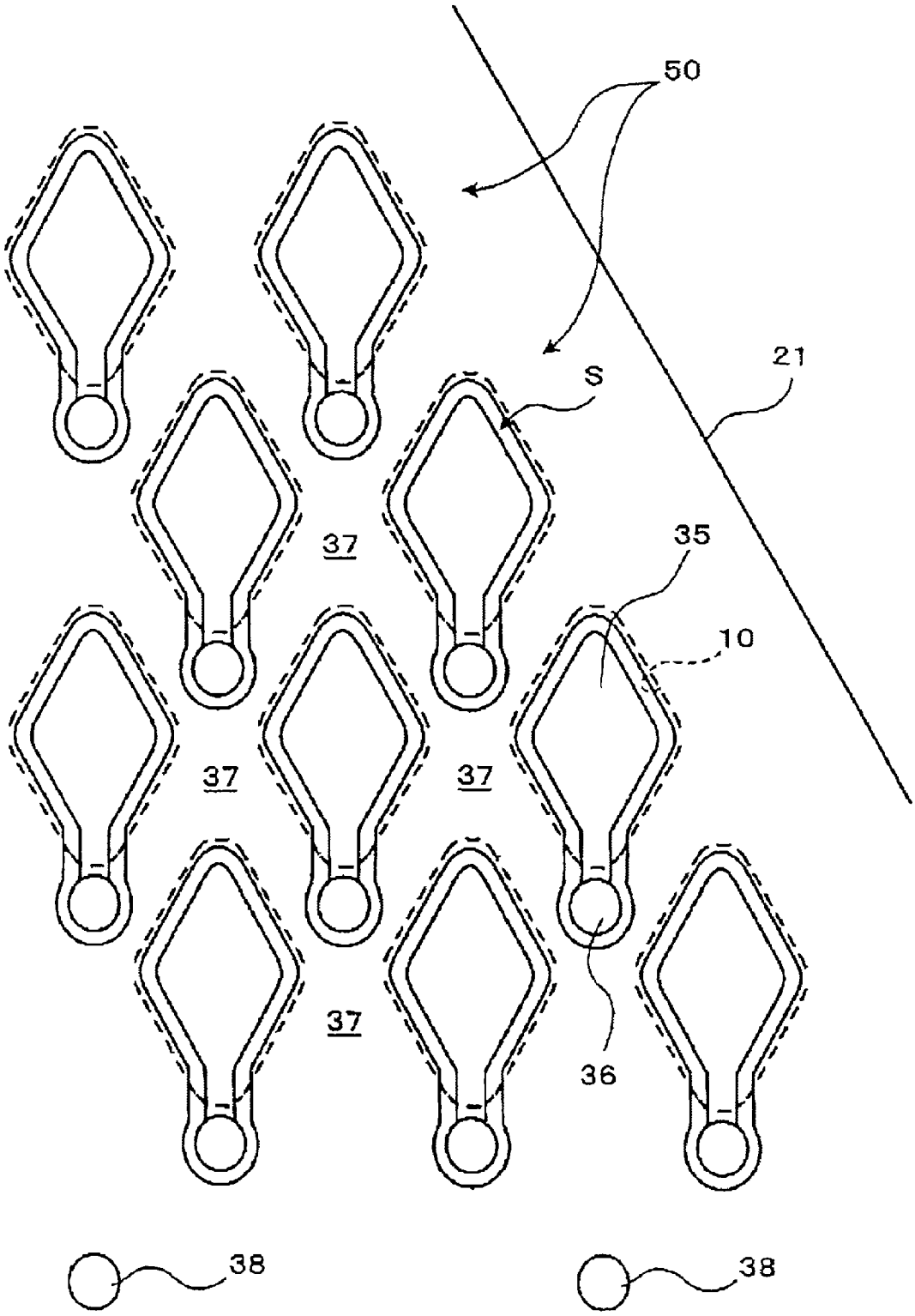
FIG. 5 is a partial enlarged plan view of the region surrounded by the broken line L in an actuator unit shown in FIG. 3.

FIG. 5 is an enlarged plan view of the region surrounded by a broken line L in FIG. 3 in which the actuator unit 21 is viewed from the upper surface. The individual electrode 35 has an almost rhomboidal shape similar to that of the pressure chamber 10. The planar size of the individual electrode 35 is smaller than the planar size of the pressure chamber 10. One acute corner of the individual electrode 35 extends in the direction opposite that of the other acute corner. The land 36 is formed on the distal end of this extending portion. The land 36 has a round planar shape.

The rhomboidal portion of the individual electrode 35 is positioned almost in the center of the region facing the pressure chamber 10 that is formed below the individual electrode 35, so as to ensure the positioning of the rhomboidal portion in this region. On the other hand, the portion extending from the acute corner of the individual electrode 35 extends to the outside of the region facing the pressure chamber 10. In other words, the land 36 is positioned in the region facing the portion where the pressure chamber 10 is not formed in the cavity plate 22.

The common electrode 34 (not shown in FIG. 5), which is kept at ground potential, is placed lower surface of the piezoelectric film 41. As described hereinabove, the active portion sandwiched between the individual electrode 35 and the common electrode 34 in the piezoelectric film 41 deforms due to a piezoelectric effect when the predetermined voltage signal is selectively supplied to the individual electrode 35. As a result, the region of the piezoelectric actuator 21 corresponding to the active portion deforms so as to protrude (project) toward the pressure chamber 10. The volume of the pressure chamber 10 is thereby decreased. A pressure is applied to the ink in the pressure chamber 10 corresponding to the individual electrode 35. As a result, the ink is discharged from the corresponding nozzle 8 via the individual ink passage 32. Thus, in the actuator unit 21, the portion facing each pressure chamber 10 and the peripheral portion thereof form individual actuator 50 (piezoelectric actuator) corresponding to each pressure chamber 10 and nozzle 8. In the present embodiment, the actuator 50 also comprises a portion surrounding the individual electrode 35.

Each individual actuator 50 forms a portion of the wall of each corresponding pressure chamber 10.

The peripheral electrode 37 has an outer peripheral shape almost identical to the outer peripheral shape of the piezoelectric film 41. A plurality of holes S larger in size than the individual electrodes 35 and of almost the same shape as the individual electrodes 35 are formed in the peripheral electrodes 37. As shown in FIG. 5, each individual electrode 35 is positioned so as to be located in the center of the hole S. As a result, the peripheral electrodes 37 cover almost the entire surface of the region where the individual electrodes 35 are not positioned on the upper surface of the piezoelectric film 41. Furthermore, the peripheral electrodes 37 and individual electrodes 35 are neither in physical nor in electric contact at the circumference of holes S.

A land 38 is formed on the upper surface of the peripheral electrode 37. The land 38 has the same shape as the land 36. The land 38 is produced from the same material as the land 36. Similarly to the lands 36, the lands 38 are electrically joined to the contacts (not shown in the figure) provided at the FPC. As described below, the controller 100 can supply various voltage signals to the peripheral electrodes 37 via the FPC. The lands 38 are formed in a plurality of sites on the actuator unit 21. As a result, when a voltage signal is supplied to a peripheral electrode 37, the peripheral electrode 37 has a uniform potential over the entire body thereof.

Furthermore, as will be described below, the piezoelectric characteristic of the piezoelectric film 41 changes when the degree of c-axis orientation decreases in the region outside the active portion in the piezoelectric film 41. Thus, the piezoelectric characteristic of the actuator 50 changes.

A common electrode 34 (not shown in FIG. 5) kept at a ground potential is also arranged in the position corresponding to the peripheral electrode 37 at the surface on the opposite side from the piezoelectric film 41. Therefore, a voltage can be applied to the region outside the active portion of the piezoelectric film 41 by applying a voltage between the peripheral electrode 37 and the common electrode 34. The peripheral electrode 37 serves to prevent the decrease in the degree of c-axis orientation by applying a voltage to the region outside the active portion. The region outside the active portion means the peripheral portion. Therefore, the peripheral electrode 37 is preferably positioned so as to cover as wide a surface of the piezoelectric film 41 as possible. For example, as shown in FIG. 5, the hole S is preferably formed so that the contour thereof is as close to the individual electrode 35 as possible. The contour of the hole S may be also located beyond the boundary of the region facing the pressure chamber 10 (the region shown by a broken line in FIG. 5). The degree of c-axis orientation will be described below.

Figure 6:
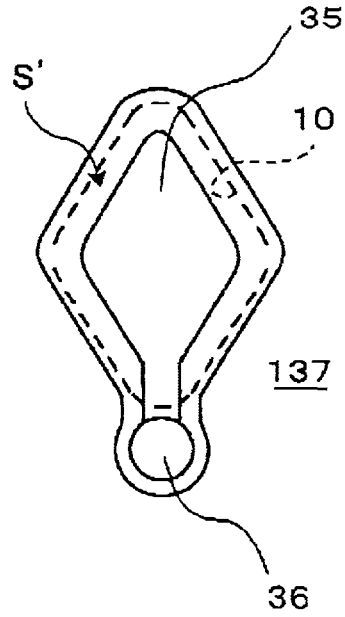
FIG. 6 is a partial enlarged plan view illustrating other type of the actuator shown in FIG. 5.

On the other hand, the waveform of a voltage signal applied to the peripheral electrode 37 may affect the ink discharge characteristic when the ink is discharged by applying the voltage signal for ink discharge operation to the individual electrode 35. In such a case, a peripheral electrode 137 modified as shown in FIG. 6 is preferably used instead of the peripheral electrode 37 shown in FIG. 5. As shown in FIG. 6, a hole S' is formed in the peripheral electrode 137. The hole S' is formed to be larger in size than the outer periphery of the pressure chamber 10 within the plane of the piezoelectric film 41. In the plane of FIG. 6, the hole S' is formed so that the entire pressure chamber 10 is located inside thereof. Thus, in the peripheral electrode 37 shown in FIG. 5, the contour of hole S was positioned within the region facing the pressure chamber 10, with the exception of the vicinity of the land 36, but in the peripheral electrode 137 shown in FIG. 6, the contour of hole S' is located outside the region facing the pressure chamber 10. With such peripheral electrode 137, when a voltage signal is applied to the peripheral electrode 137, the effect produced by this voltage signal on the ink discharge characteristic can be prevented.

Figure 7:
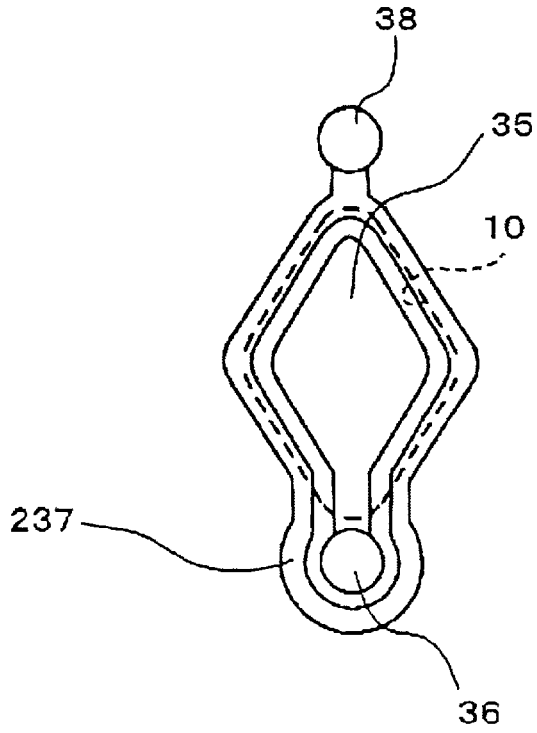
FIG. 7 is a partial enlarged plan view illustrating yet other type of the actuator shown in FIG. 5.

Furthermore, the peripheral electrodes 37 may be also formed not from a single plate covering the entree peripheral portion. For example, a configuration may be used in which a plurality of peripheral electrodes surround the circumference of each individual electrode 35. Furthermore, as shown by a peripheral electrode 237 in FIG. 7, the peripheral electrode may be formed to enclose individually the circumference of each individual electrode 35. Thus, the peripheral electrode 237 may be formed so as to enclose individually one or a plurality of individual electrodes 35.

A voltage signal for applying voltage between the peripheral electrode 37 and common electrode 34 is sent from the controller 100. The voltage signal applying voltage between the peripheral electrode 37 and common electrode 34 is referred to as a peripheral signal. The peripheral signal is applied by the controller 100. Because the common electrode 34 is grounded, the expression "applying the peripheral signal between the peripheral electrode 37 and the common electrode 34" and the expression "applying the peripheral signal to the peripheral electrode 37" describe same meaning.

The controller 100 may supply the peripheral signal to the peripheral electrode 37 in response to the changed condition of each portion of the piezoelectric film 41. Alternatively, the controller 100 may supply the peripheral signal to the peripheral electrode 37 at a timing matching the operation of each actuator 50 corresponding to each individual electrode 35.

<Control of the Actuator Unit>

Figure 8:
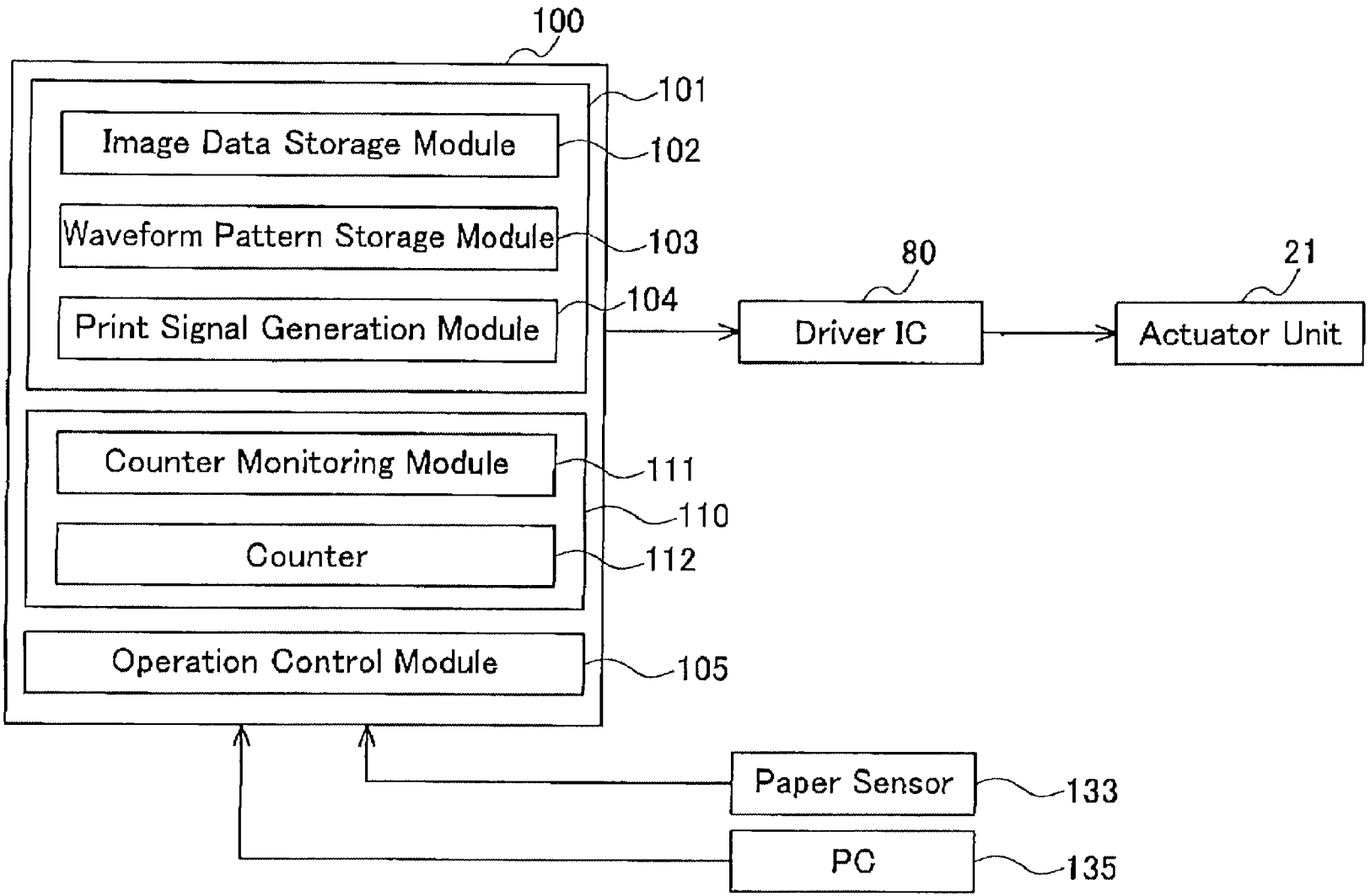
FIG. 8 is a block diagram of a controller of the inkjet printer.

The control of the actuator unit 21 will be explained below. FIG. 8 illustrates the control system of printer 1.

The printer 1 has a CPU (Central Processing Unit), a ROM (Read Only Memory) storing a program to be executed by the CPU and data used by the program, and a RAM (Random Access Memory) for temporarily storing the data during program execution. Each functional module that is described hereinbelow is composed of these elements. The CPU, ROM, and RAM are omitted from the drawings.

The control system of the printer 1 comprises the controller 10, driver IC 80, actuator unit 21, and paper sensor 133 (see FIG. 1). The driver IC 80 and paper sensor 133 are electrically connected to the controller 100. The actuator unit 21 is electrically connected to the driver IC 80.

The controller 100 has a print control module 101, a counter module 110, and an operation control module 105. Operation data or image data relating to printing are transmitted to the controller 100, e.g., from the paper sensor 133 or an external PC (Personal Computer) 135 provided on the outside. Based upon those data, the operation control module 105 controls the operation of a motor for driving the paper feed roller 145, motors for driving the feed rollers 118*a*, 118*b*, 119*a*, 119*b*, 121*a*, 121*b*, 122*a*, 122*b*, and the conveyor motor 174.

The counter module 110 has a counter 112 and a counter monitoring module 111.

The counter 112 holds a count. The counter 112 increments the count according to the predetermined conditions such as a clock number and an ink discharge count. The counter monitoring module 111 determines as to whether the count kept by the counter has reached a predetermined number that was set in advance. When the count reaches the predetermined number, the counter monitoring module 111 transmits a signal indicative thereof to the print control module 101. The counter monitoring module 111 may also have a function of determining as to whether the count has reached the predetermined number when there is a request from the print control module 101 and sending the results back to the print control module 101.

The print control module 101 has an image data storage module 102, a waveform pattern storage module 103, and a print signal generation module 104. The image data storage module 102 stores image data that were transmitted from the PC or the like and are to be printed.

Figure 12:
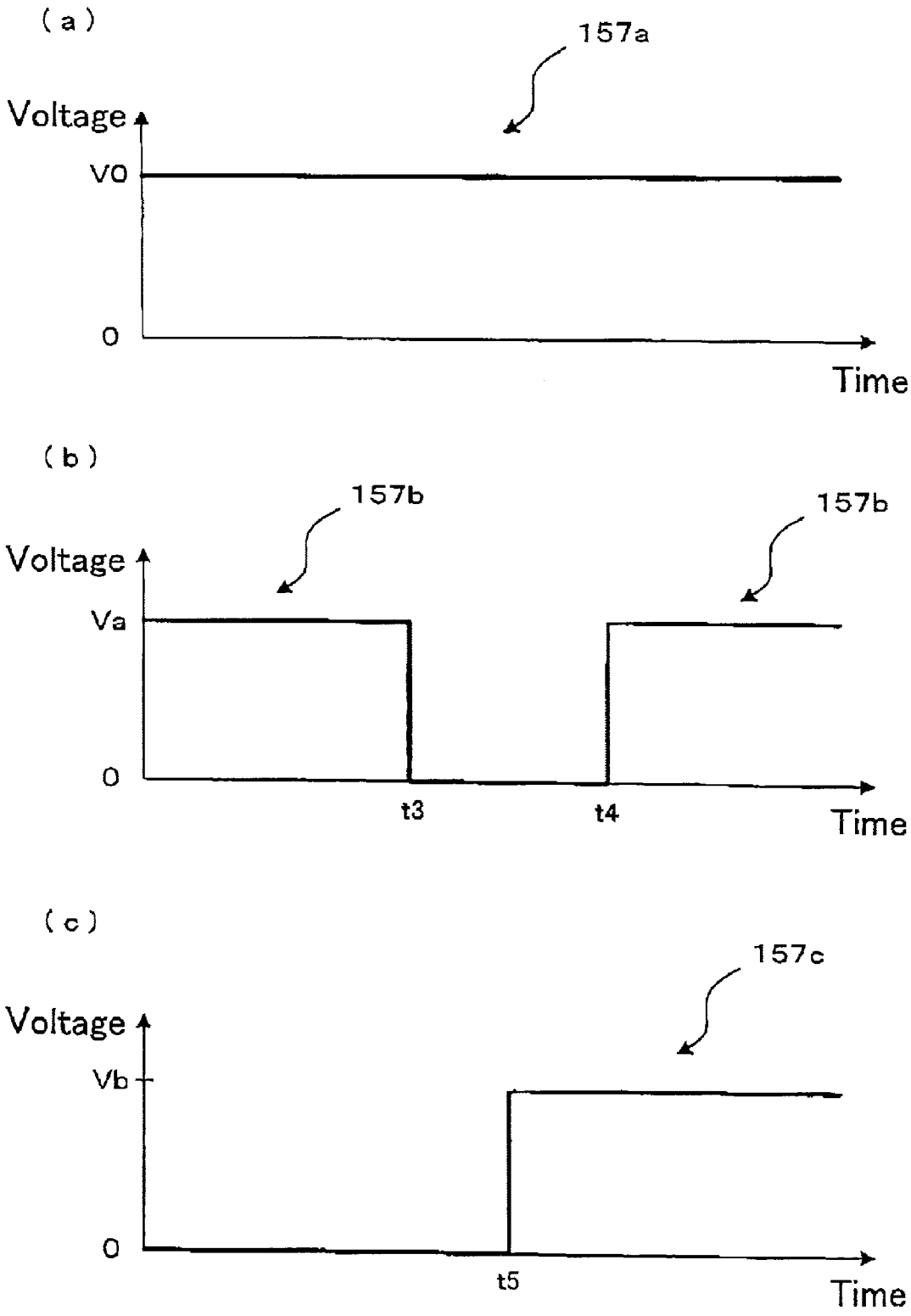
FIGS. 12(*a*)-(*c*) are schematic drawings illustrating an example of peripheral signals.
Figure 13:
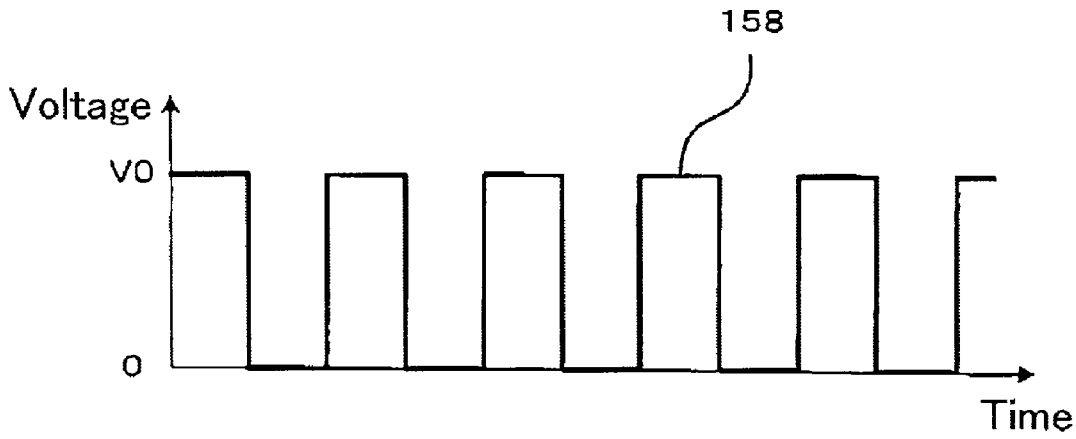
FIG. 13 is a schematic drawing illustrating another example of the peripheral signal.

The waveform pattern storage module 103 stores a plurality of types of ink discharge signal patterns 155 (see FIG. 9) and peripheral signal patterns 157 (see FIG. 12 and FIG. 13). Each respective signal pattern is actually represented by a signal sequence of voltage pulses. Each respective signal pattern is transmitted from the controller 100 to the actuator unit 21 via the driver IC 80.

The ink discharge signal pattern 155 is a basic signal pattern for representing the image tones. By using such signal pattern, a quantity of ink that corresponds to each respective tone can be discharged by the inkjet head 2.

On the other hand, the peripheral signal pattern 157 for is, as described hereinbelow, a signal pattern for applying a voltage to the peripheral portion of the piezoelectric film 41.

The print signal generation module 104 generates print data based upon the image data stored in the image data storage module 102. The print data are data in serial format. The print signal generation module 104 outputs the generated print data to the driver IC 80 that corresponds to each actuator unit 21.

From a plurality of signal patterns stored in the waveform pattern storage module 103, the print signal generation module 104 selects a signal pattern that has to be outputted to each individual electrode 35 so as to print the image that is to be printed. The print data are generated based upon the selected signal pattern. The print data also include data that indicate the timing for outputting the selected signal pattern to the driver IC 80. More specifically, based upon the image data, the print signal generation module 104 generates print data corresponding to the ink discharge signal pattern 155 for discharging ink at a predetermined timing from the predetermined nozzle 8.

Furthermore, the print signal generation module 104 calculates the timing for applying the peripheral signal pattern 157 to the peripheral electrodes 37 based upon the signal from the counter monitoring module 111 or printing state. The print signal generation module 104 generates print data corresponding to the peripheral signal pattern 157 at the calculated timing.

The print data generated by the print signal generation module 104 are transmitted to the corresponding driver IC 80.

The driver IC 80 has a shift resister, a multiplexer, and a drive buffer. The shift resister, multiplexer, and drive buffer are omitted from the drawings.

The shift register converts the print data in serial format that were outputted from the print signal generation module 104 into data in parallel format. Simultaneously therewith, the shift register converts the print data into individual data for the actuator 50 that corresponds to each pressure chamber 10 and nozzle 8. The converted data are outputted to the multiplexer.

The multiplexer selects the suitable data from among a plurality of types of data of the ink discharge signal pattern and the data of the peripheral signal pattern, based upon the data outputted by the shift register. The multiplexer outputs the selected data to the drive buffer.

The drive buffer generates ink discharge signals having voltage level suitable for driving the actuator 50, based upon the ink discharge signal pattern outputted from the multiplexer. Simultaneously therewith, the driver buffer generates peripheral signals the having voltage level suitable for driving the actuator 50, based upon the peripheral signal pattern outputted from the multiplexer. The driver buffer supplies the generated ink discharge signal for ink discharge operation to the individual electrodes 35 that correspond to each actuator 50 via the FPC. Likewise, the driver buffer supplies the generated peripheral signal to the peripheral electrodes 37 that correspond to each actuator 50 via the FPC.

<Transition of the Electric Potential at the Individual Electrode During the Ink Discharge Operation>

The ink discharge signal and the transition of the electric potential at the individual electrodes 35 to which this signal is applied will be explained below. Because the common electrode 34 is grounded, the expression "applying the ink discharge signal between the individual electrode 34 and the common electrode 34" and the expression "applying the ink discharge signal to the individual electrode 34" describe same meaning. In the explanation below, a printing interval T0 means the time required to convey printing sheet P through a unit distance corresponding to a printing resolution along the conveying direction of the printing sheet P. In other words, the printing interval T0 means the minimum time needed after ink is discharged from one nozzle 8 for ink to be discharged therefrom again. The printing interval T0 is determined by the conveying speed of the printing sheet P and the printing resolution of the printer 1.

Figure 9:
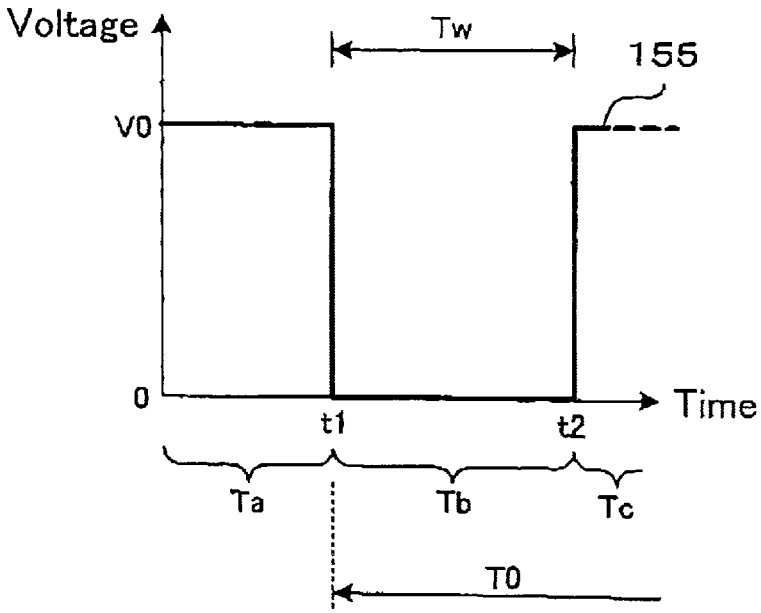
FIG. 9(*a*) is a schematic drawing of an ink discharge signal.
Figure 9:
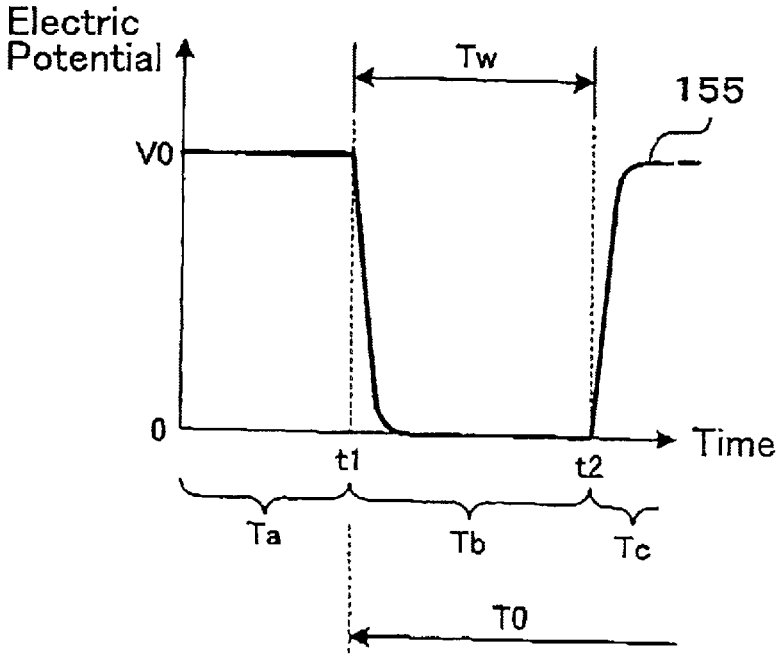

The voltages included in the ink discharge signal at each point in time will be explained below. FIG. 9(*a*) is a schematic drawing of a waveform 155 of the ink discharge signal applied from the driver IC 80 to the actuator unit 21. The waveform of the ink discharge signal shown in FIG. 9 is an example of a waveform for discharging one droplet of ink from a nozzle 8 in the printing interval T0 during a printing period.

Time t1 is the time at which the ink discharge signal starts to be applied to individual electrode 35. Time t2 is the time at which the ink discharge signal ends. The voltage change at the time t1 is referred to as an advanced voltage change at a start timing of ink discharge signal. The voltage change at the time t2 is referred to as a subsequent voltage change at an end timing of ink discharge signal. Time t2 is adjusted at the timing at which ink is discharged from nozzle 8 that corresponds to the individual electrode 35. The time period Tw from the advanced voltage change at the timing t1 to the subsequent voltage change at the timing t2 of the ink discharge signal 155 is set to satisfy a relation that the subsequent voltage change at the timing t2 is applied when positive pressure is developed within the pressure chamber due to the pressure wave generated by the advanced voltage change at the timing t1.

The voltage will be kept at a predetermined V0 in a period Ta that is prior to the start timing t1 of the ink discharge signal and a period Tc that is after the end timing t2 of the ink discharge signal time t2. The voltage will be kept at zero in period T'. In other words, the ink discharge signal 155 comprises the advanced voltage change from the predetermined voltage V0 to zero voltage and the subsequent voltage change from zero voltage to the predetermined voltage V0. The subsequent voltage change is delayed form the advanced voltage change for the period Tb.

FIG. 9(*b*) shows the transition of electric potential at the individual electrode 35 in the case where the waveform 155 of the ink discharge signal is applied to the individual electrode 35.

As shown in FIG. 4, the individual electrode 35 and the common electrode 34 have a function that is equivalent to a condenser due to the piezoelectric film 41 acting as a dielectric. Therefore, as shown in FIG. 9(*b*), the electric potential of the individual electrode 35 changes with a delay corresponding to the charge-discharge time of the condenser.

<Operation of the Actuator During an Ink Discharge Operation>

How the actuator 50 operates when the above-described ink discharge signal is applied to the individual electrode 35 will be explained below.

First, the state of the actuator unit 21 when the electric potential of the individual electrode 35 is at the potential other than the ground potential (zero voltage) will be explained. In the actuator unit 21 of the present embodiment, the uppermost piezoelectric film 41 is polarized along a direction extending from the individual electrode 35 to the common electrode 34. By making the electric potential of the individual electrode 35 different from that of the common electrode 34, voltage can be applied to the piezoelectric film 41 in the same direction as of the polarized direction. If a voltage is applied to the piezoelectric film 41, the portion to which the voltage was applied, that is, the active portion, extends in the thickness direction due to the piezoelectric effect. The thickness direction as referred herein is the direction in which the piezoelectric film 41 and diaphragms 42-44 are laminated. At this time, the active portion contracts in the direction perpendicular to the lamination direction, that is, in planar direction of the piezoelectric film 41.

On the other hand, when the diaphragms 42-44 are produced from a material other than a piezoelectric material, for example, from a metal material, the diaphragms 42-44 do not deform even if voltage is applied. Furthermore, even when the diaphragms 42-44 are produced from a piezoelectric material, the diaphragm 42-44 have resistance to spontaneous deformation even if voltage is applied, unless the piezoelectric material is polarized.

Because the difference in strain thus occurs between the piezoelectric film 41 and the diaphragms 42-44, each actuator 50 deforms so as protrude as a whole toward the pressure chamber 10. This type deformation is called unimorph deformation.

Figure 10:
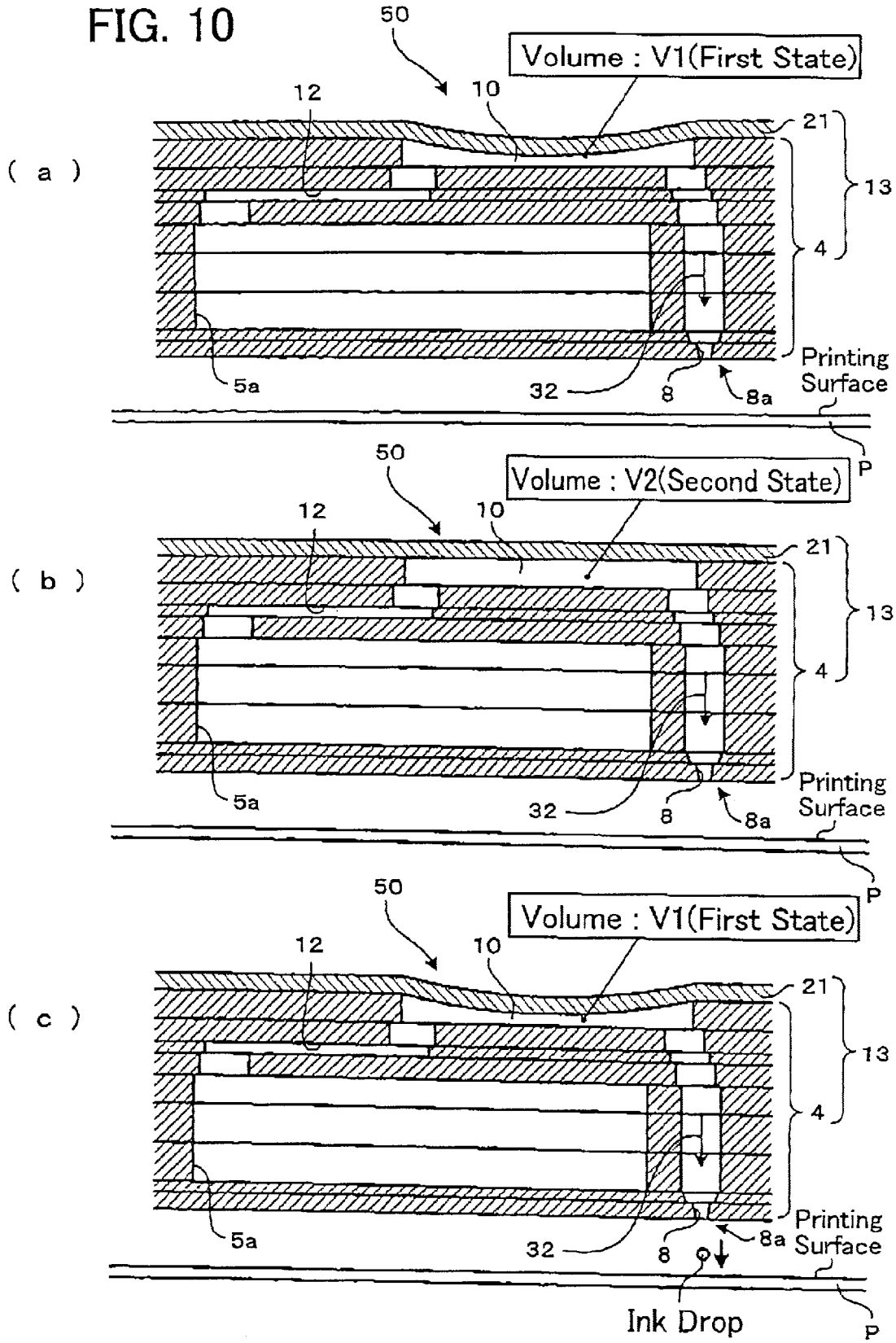
FIGS. 10(*a*)-(*c*) are explanatory drawings illustrating an operation of the actuator unit when the ink discharge signal shown in FIG. 9(*a*) is applied.

The operation of the actuator 50 when the ink discharge signal 155 is applied to the individual electrode 35 will be explained below. FIGS. 10(*a*)-(*c*) show transition of the state of the actuator 50 during the ink discharge operation in this case. As shown in FIGS. 10(*a*)-(*c*), the actuator 50 forms a portion of the inner wall of the pressure chamber 10.

FIG. 10(*a*) shows the state of the actuator 50 during period Ta shown in FIG. 9(*b*). At this period, the electric potential of the individual electrode 35 is V0. On the other hand, the common electrode 34 (see FIG. 4) is always kept at ground potential. Thus, the predetermined voltage V0 is applied between the individual electrode 35 and common electrode 34.

Due to unimorph deformation, the actuator 50 deforms so as to protrude into the pressure chamber 10. The volume of the pressure chamber 10 at this time is V1. Thus, if the voltage V0 is applied between the individual electrode 35 and common electrode 34, the volume of the pressure chamber 10 becomes V1. The state of the actuator 50 at this point will be referred to as the first state.

FIG. 10(*b*) shows the state of the actuator 50 during the period Tb shown in FIG. 9(*b*). At this period, the electric potential of the individual electrode 35 is zero voltage (ground potential). Thus the active portion of the piezoelectric film 41 of the actuator 50 will be in a state in which a zero voltage is applied. Therefore, the unimorph deformation of the actuator 50 is released and the actuator returns to the original state. The volume of the pressure chamber 10 at this time is V2. Thus, if a zero voltage is applied to the individual electrode 35, the deformation of the actuator 50 is released. As a result, the volume of the pressure chamber becomes V2. The volume V2 of the pressure chamber 10 is larger than the volume V1 of the pressure chamber 10 shown in FIG. 10(*a*). The state of the actuator 50 at this point will be referred to as the second state. Because the volume of the pressure chamber 10 thus increases from V1 to V2, ink is drawn into the pressure chamber 10 from the sub-manifold passage 5*a*.

FIG. 10(*c*) shows the state of the actuator 50 during the period Tc shown in FIG. 9(*b*). At this period, the electric potential of the individual electrode 35 again becomes V0. Therefore, the actuator 50 returns again to the first state. When the actuator 50 thus returns from the second state to the first state, a pressure is applied to the ink in the pressure chamber 10. As a result, an ink droplet is discharged from the ink discharge opening 8*a* in the tip of the nozzle 8. The ink droplet strikes the printing surface of the printing sheet P and forms a dot.

Thus, during the ink discharge operation of the actuator 50, the volume of the pressure chamber 10 will first become temporarily enlarged (from the state shown in FIG. 10(*a*) to the state shown in FIG. 10(*b*)), and a negative pressure will be generated within the ink in the pressure chamber 10. The generated negative pressure will cause a pressure wave. The pressure wave will propagate the ink passage formed inside the passage unit 4. This pressure wave will propagate through the ink, and will reflect at the end portions of the ink passage. One end of the ink passage is the aperture 12. The other end of the ink passage is the nozzle 8. The pressure wave changes from a negative pressure to a positive pressure when reflected.

The reflected pressure wave will return to the pressure chamber 10. When the pressure wave returns to the pressure chamber 10, positive pressure is developed within the pressure chamber 10. Subsequent voltage change from zero voltage to the predetermined voltage V0 is applied to the individual electrode 35 when the pressure wave returns to the pressure chamber 10 and positive pressure is developed within the pressure chamber 10.

The period Tw of the ink discharge signal 155 from the advanced voltage change at timing t1 to the subsequent voltage change at timing t2 is ideally the time that AL (Acoustic Length) is divided by penetrating speed of the pressure wave. Here, AL is the distance from the aperture 12 to the nozzle 8. The pressure chamber 10 is just a middle position between the aperture 12 and the nozzle 8. Note that the period Tw, in which the voltage of the individual electrode 35 changes from V0 to ground voltage, and again returns to V0, is substantially equivalent to the period in which the volume of the pressure chamber 10 changes from V1 to V2, and again returns to V1.

By making the period Tw as described, the positive pressure generated by the reflected pressure wave in the pressure chamber 10 will be superimposed over the positive pressure generated by the deformation of the actuator 50. In this way, a stronger positive pressure can be applied to the ink. Thus, as compared with simply reducing the volume of the pressure chamber one time in order to push ink out, the drive voltage of the actuator 50 for discharging the same quantity of ink can be reduced. Therefore, the aforementioned ink discharge operation is useful for increasing the integration of the pressure chambers 10, making the inkjet head 2 more compact, and reducing the running cost when driving the inkjet head 2. The aforementioned ink discharge operation is referred to as "fill before fire".

In the present embodiment, applying voltage by the ink discharge signal 155 changes from the predetermined voltage V0 to zero voltage and returns from zero voltage to the predetermined voltage. The controller 100 may apply other ink discharge signal in which the applying voltage changes from the predetermined voltage to a lower voltage and returns from the lower voltage to the predetermined voltage. Ink can be discharged from the nozzle 8 by applying the above mentioned other ink discharge signal. Even in such case, ink discharge operation is also called "fill before fire".

<Change in the Characteristics of the Piezoelectric Actuator>

It has been confirmed by the inventors that when ink is continuously discharged for a long period of time under predetermined conditions by means of the aforementioned "fill before fire method", changes occur in the ink discharge characteristics of the actuator 50. For example, when the actuator 50 is driven at a normal drive frequency of 20 kHz, the ink discharge signal 155 is applied at a frequency that is much lower than the drive frequency. Then, after the ink discharge signal is applied a hundred million times at a low frequency, a quantity of ink discharged from the nozzle 8 will be decline. Also, the speed of the ink discharged from the nozzle 8 is slowed. For example, when one million ink discharge signals are applied to the actuator 50 at 20 kHz, a prominent change in the discharge characteristics of the actuator 50 was not observed. However, when one million ink discharge signals were applied to the actuator 50 at 2 kHz, a prominent change in the discharge characteristics of the actuator 50 was observed. In other words, when the ink discharge signal 155 is applied to the actuator 50 at a frequency that is lower than the fastest drive frequency, a change in the discharge characteristics of the actuator 50 will occur. On the other hand, there was almost no change in the discharge characteristics of the actuator 50 when the voltage V0 is continuously applied to the actuator 50 for a period that one million ink discharge signals are applied of at 2 kHz.

Figure 11:
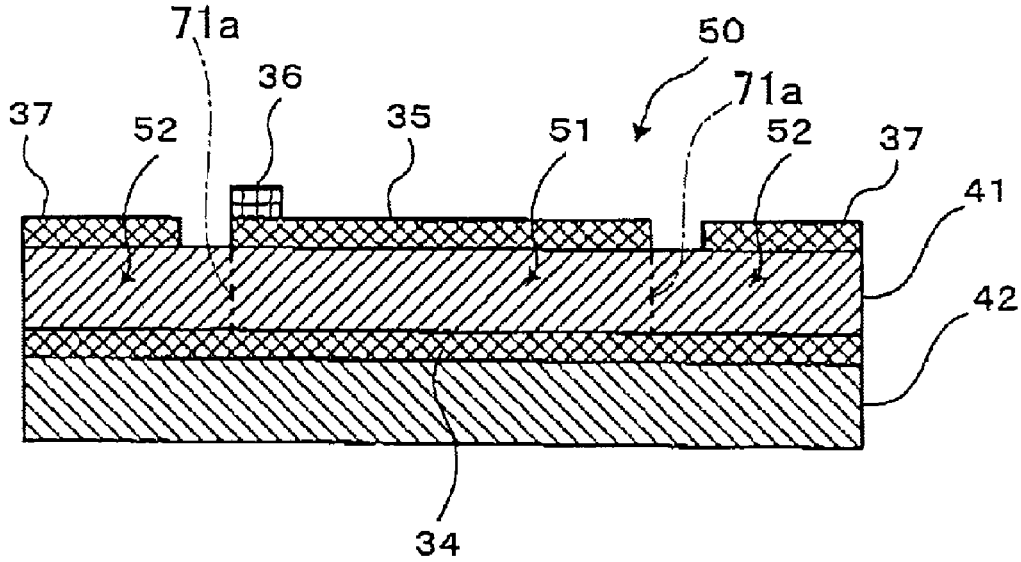
FIGS. 11(*a*), (*b*) are explanatory drawings illustrating a change in a characteristic occurring in the actuator unit shown in FIG. 4.
Figure 11:
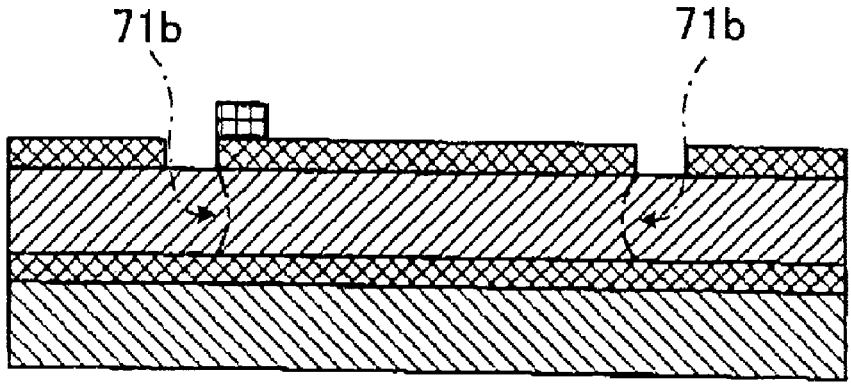

This type of change in the characteristics of the actuator 50 is assumed to be caused by the following mechanism. FIG. 11 explains the characteristic change of the actuator 50.

The polarization of the piezoelectric film 41 will be explained prior to explaining the specific mechanism of the change in characteristics. The polarization of the piezoelectric film 41 is performed in order to increase the contraction amount in the planar direction of the piezoelectric film during voltage application. The polarization of the piezoelectric film is generally performed by applying a high voltage at a high temperature.

Ferroelectrics such as PZT have crystal grain units that have spontaneous polarization. However, there are various orientations of the spontaneous polarization of these crystal grain units prior to the polarization of the piezoelectric film. In this case, the piezoelectric film is not, as a whole, polarized along a uniform direction. In contrast, when a high voltage is applied to the piezoelectric film at a high temperature as described above, the direction of the spontaneous polarization of each crystal grain units can be placed in a particular direction. In this way, the piezoelectric film as a whole can be polarized along the particular direction. The expression "the direction of the spontaneous polarization can be placed along the particular direction" means that the direction of the spontaneous polarization for majority of the crystal grain units can be placed along a direction close to a single common direction. The expression does not mean that the direction of the spontaneous polarization for all of the crystal grain units is placed exactly in the single common direction. In other words, such expression in this embodiment means that the piezoelectric film, as a whole, can be polarized. Such kind of expressions is used as same meanings in this specification. In the present embodiment, the piezoelectric film 41 is substantially polarized along the direction of lamination. In other words, in the present embodiment, the piezoelectric film 41 is substantially polarized along a direction extending from the individual electrode 35 to the common electrode 34.

Here, the changes prior to the polarization of certain crystal grain units in the piezoelectric film, and the changes after the polarization thereof, will be considered. Each respective crystal lattice included in the crystal grain units, and each respective crystal lattice unit, have spontaneous polarization. Crystal lattices that are assembled in a spontaneous polarization direction are gathered inside the crystal grain unit, and form a large number of domains. Spontaneous polarization of crystal grain unit expresses the total amount of spontaneous polarization in the domains that are distributed inside the crystal grain unit. Prior to the aforementioned polarization process, the directions of the spontaneous polarization of the domains are random, and the crystal grain units as a whole do not exhibit piezoelectric characteristics. In contrast, by polarizing the piezoelectric film, the crystal grain unit will exhibit piezoelectric characteristics, because the directions of spontaneous polarization of the domains inside the crystal grain unit align along the common direction (the direction in which the piezoelectric film 41 and diaphragms 42-44 are laminated in the present embodiment).

Even if a polarization process is performed, the polarization directions of all the crystal lattices inside the crystal grain unit will not be aligned perfectly along the single common direction. There are domains inside the crystal grain unit after polarization in which the direction of spontaneous polarization aligns with the common direction, and there are also domains in which the directions of spontaneous polarization do not align with the common direction. Because these domains tend to have a certain distribution tendency, the crystal grain units as a whole will be polarized in the uniform direction. In the following explanation, the term "c-axis orientation" will be used to refer to the spontaneous polarization direction of each domain in a crystal grain being close to the lamination direction. In addition, the term "a-axis orientation" will be used to refer to the spontaneous polarization direction of each domain in a crystal grain being close to a direction that is perpendicular to the lamination direction (the lamination plane direction). Note that the degree of c-axis orientation that represents the extent of the c-axis orientation is observed as the intensity ratio of a 002 diffraction pattern with respect to 200 diffraction in X-ray diffraction. Amongst these, the 002 diffraction corresponds to the diffraction from a plane oriented on the c-axis of the crystal axis.

The mechanism by which a change of piezoelectric characteristics are produced in the piezoelectric film 41 will be explained below referring FIG. 9. As noted above, when ink is not discharged from the nozzle 8 corresponding to the actuator 50, a fixed voltage V0 is applied between the individual electrode 35 and the common electrode 34 (period Ta and Tc in FIG. 7). At these periods, the active portion 51 in the piezoelectric film 41 that is sandwiched between the two electrodes will contract along the planar direction of the piezoelectric film 41. Therefore, the peripheral portion 52 of the piezoelectric film 41 that is not sandwiched by the individual electrode 35 and the common electrode 34 will receive tensile stress along the planar direction due to the active portion 51.

When the ink discharge signal 155 is applied to the individual electrode 35, the contraction of the active portion 51 is temporarily released during the period Tw (see FIG. 9). The contracted state will be restored thereafter. Thus, the tensile stress received by the peripheral portion 52 is also temporarily released during period Tw, and the state in which the tensile stress is received will be restored again thereafter.

In this type of situation, the ink discharge signal 155 is continuously applied to the individual electrode 35 at a predetermined low frequency. When this occurs, a phenomenon will occur in which the degree of c-axis orientation in the peripheral portion 52 will gradually decline, and will not return to the original state. While the degree of c-axis orientation in the peripheral portion 52 declines, a strain which elongate the peripheral portion 52 toward the adjacent active portion 51 grows. Because of this, the peripheral portion 52 assumes a state in which it is elongated along the planar direction more than in the initial state 71*a* shown in FIG. 11(*a*), as shown by the broken line 71 in FIG. 11(*b*). Therefore, the active portion 51 suffers compression stress from the adjacent peripheral portion 52.

Thus, the active portion 51 suffers compression stress from the peripheral portion 52. As a result, the degree of c-axis orientation of the active portion 51 increases. In the active portion 51, the distribution mode of the crystal orientation inside the crystal grain units changes from the initial state.

The displacement that occurs when an external voltage is applied to a polarized piezoelectric film is mainly observed as the sum of the warping due to electrostriction that deforms in the c-axis direction of c axis oriented crystal lattices, and the warping caused by changes in the orientation of the domains (rotation of the crystal axis).

The contribution of the changes in the orientation of the domains to the displacement quantity of the piezoelectric film is large. However, in a state in which compressive stress is steadily applied from the peripheral portion 52, the domains that can change orientation under the application of an external voltage will be reduced. As a result, the amount of contraction of the active portion 51 caused by such change in the internal structure of the crystal grain units will be reduced. If the amount of contraction of the active portion 51 is reduced, the amount of ink discharged from the nozzle 8 will decrease. Also, the speed of ink discharged from the nozzle 8 will slow. Thus, if the inkjet printer is used for a long time, the characteristics of the piezoelectric actuator will change from the initial characteristics. As a result, the ink discharge characteristic will change.

<Operation of the Actuator by Means of Peripheral Signals>

The change of the characteristics of the piezoelectric film 41 is induced, as mentioned above, by the decrease in the degree of c-axis orientation in the peripheral portion 52. On the other hand, when voltage is applied between the peripheral electrode 37 and the common electrode 34, electric field along the thickness direction appears in the peripheral portion 52. When electric field of a predetermined intensity is applied to the peripheral portion 52 along the thickness direction, the degree of c-axis orientation in the peripheral portion 52 can be increased. As a result, the crystal orientation in the peripheral portion 52 can be returned to the original state. Thus, the change in the orientation distribution in the peripheral portion 52 and active portion 51 (change in the internal structure) can be prevented.

FIGS. 12(*a*)-(*c*) illustrate examples of peripheral signals 157*a*, 157*b*, 157*c* for preventing the change of the characteristics of the peripheral portion 52 and active portion 51. When one of the signals shown in FIG. 12(*a*)-(*c*) is applied to the peripheral electrode 37, the electric potential of the peripheral electrode 37 changes with a delay shown in FIG. 9(*b*). To avoid repetition, the detailed description of the change in the electric potential in the peripheral electrode 37 is hereinbelow omitted.

The peripheral signal 157*a* shown in FIG. 12(*a*) is the signal that keeps the electric potential of the peripheral electrode 37 at the fixed potential V0. By applying the peripheral signal 157*a* to the peripheral electrode 37 by the controller 100, the electric potential of the peripheral electrode 37 is kept at V0. The electric potential of the common electrode 34 that faces the peripheral electrode 37 and sandwiches together therewith the piezoelectric film 41 is kept at zero voltage (ground potential). Therefore, the voltage V0 is applied between the peripheral electrode 37 and common electrode 34. As a result, voltage for preventing the decrease in the degree of c-axis orientation in the peripheral portion 52 is applied to the peripheral portion 52. The peripheral signal 157*a* is applied to the peripheral electrode 37, regardless of whether or not the ink discharge signal is applied. Alternatively, the peripheral signal 157*a* may be applied to the peripheral electrode 37 all the time during the operation of the printer 1. The operation of the printer 1 means a state in which the main power source of the printer 1 is ON. As a result, a state with the decreased degree of c-axis orientation in the peripheral portion 52 can be maintained to its initial state all the time.

Because the peripheral signal 157*a* is applied regardless of whether or not the ink discharge signal is applied, voltage is applied to the peripheral portion 52 even when the ink is discharged. At this time, the peripheral portion 52 contracts in the planar direction. As a result, the active portion 51 suffers a tensile stress from the peripheral portion 52. This tensile stress sometimes affects the ink discharge operation. However, the effect of the application of the peripheral signal 157*a* on the ink discharge operation can be prevented for the reason as follows.

Thus, by applying the peripheral signal 157*a* to the peripheral electrode 37, the electric field appearing in the piezoelectric field 41 is almost constant over the entire plane of the piezoelectric film 41. In other words, the effect produced by the application of the peripheral signal 157*a* on the ink discharge operation of each active portion 51 corresponding to each individual electrode 35 is almost constant. For this reason, hardly any spread occurs in the ink discharge characteristic of each active portion 51. Alternatively, the intensity of the voltage of the peripheral signal 157*a* may be suppressed to a level producing hardly any effect on the active portion 51, while still preventing the decrease in the degree of c-axis orientation in the peripheral portion 52. Furthermore, the applying peripheral signal is set in advance. In other words, the effect produced by the application of the peripheral signal on the active portion 51 is predictable. Therefore, the signal for the ink discharge operation that is applied to the individual electrode 35 can be adjusted in advance by taking into consideration the effect produced by the application of the constant peripheral signal 157*a*, so as to prevent the decrease in quality of printing by means of ink discharge.

Depending on the intensity and/or timing of the peripheral signal, stresses that enhance the ink discharge operation may be applied to the active portion 51 due to voltage applied to the peripheral electrode 37. By applying the peripheral signal that produces such an effect to the peripheral electrode 37, the ink discharge operation can be performed more effectively.

On the other hand, depending on the intensity and waveform of the peripheral signal, the peripheral portion 52 deformed by voltage application sometimes affects the ink discharge characteristic. For example, during the ink discharge operation, a voltage Va that is appropriately larger than the voltage V0 (the predetermined voltage in the ink discharge signal) may be applied to the peripheral electrode 37. Alternatively, the signal having a waveform with alternatively repeating states with a low voltage and a high voltage may be applied to the peripheral electrode 37 (see FIG. 13). When such signal is used as the peripheral signal, it is necessary to provide a state in which the peripheral signal is not applied and no voltage is applied to the peripheral portion 52 during the period in which ink discharge signal is applied.

More specifically, the peripheral signal 157*b* shown in FIG. 12(*b*) may be applied to the peripheral electrode 37. The period from time t3 to time t4 in FIG. 12(*b*) is the period in which the ink discharge signal is applied to the corresponding individual electrode 34 surrounded by the peripheral electrode 37 to which the peripheral signal 157*b* is applied. The peripheral signal 157*b* is the signal kept at a voltage Va sufficiently higher than the voltage V0. Depending on the voltage applied to the peripheral electrode 37 corresponding to the nozzle 8 that discharges the ink, there is a possibility that the discharge characteristic of the ink discharged from this nozzle 8 will be disturbed. Therefore, the peripheral signal 157*b* is applied to the peripheral electrode 37 only in the period before time t3, which is the start timing of applying the ink discharge signal, and in the period after time t4, which is the end timing of applying the ink discharge signal. Within the period from time t3 to time t4, the electric potential of the peripheral electrode 37 is kept at zero (ground potential). The disturbance produced by the applied peripheral signal on the ink discharge characteristic can thus be prevented even when a large voltage is applied to the peripheral electrode 37.

Furthermore, the peripheral signal is applied, as described hereinabove, by the printing control module 101. The printing control module 101 determines the timing at which the application of the peripheral signal is started, with the counter module 110, with the exception of the case where the signal is applied all the time during the operation of the printer 1. For example, the counter module 110 counts the entire drive time from the point in time the printer 1 was initially driven to the present time by using the clock number as a reference. Furthermore, at the point in time the count reaches the predetermined number, the printing control module 101 is notified that the count reaches the predetermined number by the counter module 111. Based on this notification, the printing control module 101 starts the application of the peripheral signal. FIG. 12(*c*) shows an example, in which the application of the peripheral signal 157*c* kept at a constant voltage Vb is started, for example, at time t5. Prior to time t5, the peripheral signal is not applied and the potential of the peripheral electrode 37 is kept at zero voltage. In other words, prior to time t5 at which the count reaches the predetermined number, the controller 100 applies no peripheral signal between the common electrode 34 and peripheral electrode 37. In the subsequent period after time t5 at which the count reaches the predetermined number, the controller applies the peripheral signal of the voltage Vb between the common electrode 34 and peripheral electrode 37.

<Other Examples of Peripheral Signals>

FIG. 13 shows a signal 158 that is suitable as the peripheral signal and has a waveform different from the above-described waveform. The peripheral signal 158 is a pulse sequence signal in which the voltage zero and the voltage V0 are repeated cyclically with the prescribed intervals. The interval in which the voltage zero is applied is set to a value shorter than the above-described print interval T0. As a result, the active portion and peripheral portion are released from deformations within the interval in which the ink is continuously discharged, that is, within the interval that is shorter than the print interval T0. By releasing the piezoelectric actuator from deformations within the interval shorter than the print interval T0, the characteristic change of the piezoelectric actuator can be reduced effectively.

Thus, signals of variety waveforms can be employed as the peripheral signals. Among them, a signal having a waveform that most effectively prevents the decrease in the degree of c-axis orientation in the peripheral portion 52 is preferably used. For example, the interval preferably has a length shorter than the above-described print interval T0.

<Example of Another Configuration of the Actuator Unit>

Figure 14:
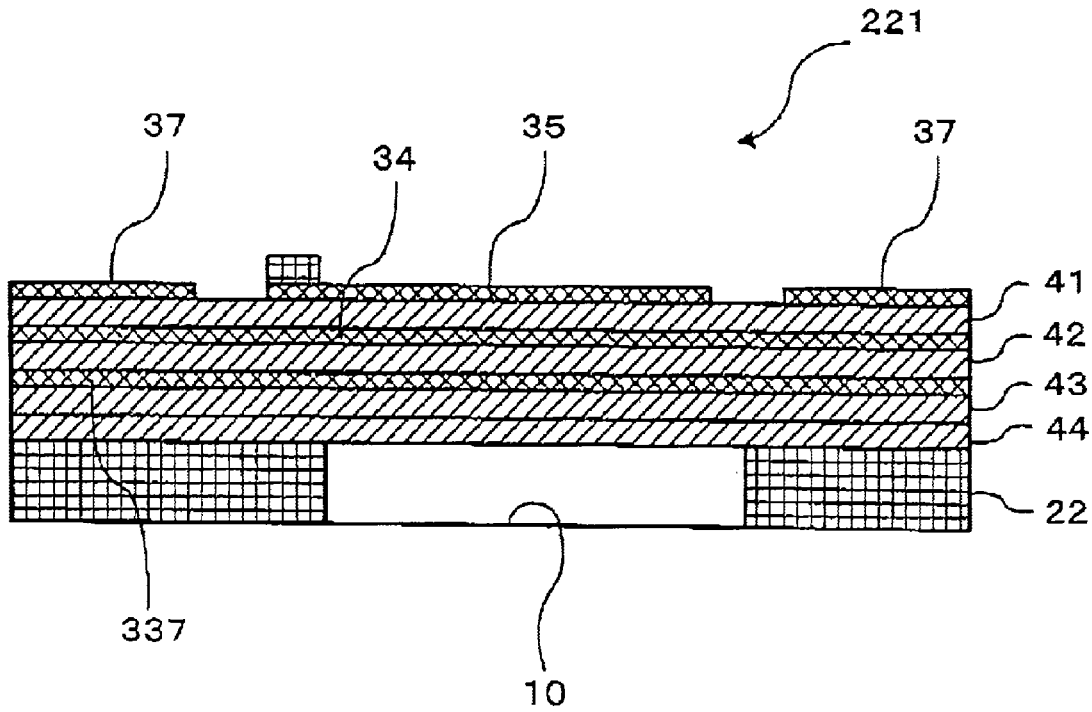
FIG. 14 is a partial cross-sectional view of the actuator unit having a configuration different from that of the actuator unit shown in FIG. 4.

Another configuration of the actuator unit 21 will be described below. FIG. 14 is a partial cross-sectional view of an actuator unit 221 of another embodiment of the present invention.

The actuator unit 221 includes many features similar to those of the actuator unit 21 shown in FIG. 4. For example, the actuator unit 221 has a piezoelectric film 41, an individual electrode 35, a common electrode 34, and a peripheral electrode 37. The common electrode 34 extends over the entire surface of the actuator unit 221 between the piezoelectric film 41 and the diaphragm 42. Furthermore, the individual electrode 35 and the common electrode 34 sandwich a region facing a pressure chamber 10 in the piezoelectric film 41. Because the individual electrode 35 is formed in the region facing the pressure chamber 10, the piezoelectric film 41 has a region which is not sandwiched between the individual electrode 35 and the common electrode 34. Furthermore, the peripheral electrode 37 and the common electrode 34 sandwich a region in the piezoelectric film 41 that is not sandwiched by the individual electrode 35 and the common electrode 34.

On the other hand, by contrast with the actuator unit 21, in the actuator unit 221, the diaphragms 42-44 are made of PZT.

The actuator unit 221 has a second common electrode 337. The actuator unit 21 shown in FIG. 4 does not have the second common electrode 337.

The second common electrode 337 extends along the entire surface of the actuator unit 221 between the diaphragm 42 and diaphragm 43. The second common electrode 337 together with the common electrode 34 sandwich the diaphragm 42.

The second common electrode 337 is electrically connected to the printing control module 101 via a FPC in the region that is not shown in the figure. The printing control module 101 can apply a variety of voltage signals to the second common electrode 337 via the FPC and the driver IC 80. The voltage signals applied to the second common electrode 337 include signals with various waveforms such as shown in FIG. 12, etc.

The configuration of the actuator unit 221 has the following advantages.

Similarly to the actuator unit 21, when no peripheral signal is applied between the peripheral electrode 37 and common electrode 37, the piezoelectric characteristic of the piezoelectric film 41 changes while the actuator unit 221 is used for a long time.

When the diaphragm 42 comprises PZT, the polarization orientation in the diaphragm 42 also changes while the actuator unit 221 is used for a long time. The change in the polarization orientation state in the diaphragm 42 occurs in the region corresponding to the individual electrode 35 in the laminating direction of the piezoelectric film 41 and diaphragm 42. This region is referred as a lamination active portion. Microscopic structural changes in the diaphragm 42 occur because the degree of c-axis orientation in the lamination active portion of the diaphragm 42 is increased by piezoelectric deformation of the active portion of the piezoelectric film 41.

On the other hand, the actuator unit 221 has the second common electrode 337. When voltage signal is applied between the second common electrode 337 and the common electrode 37, electric field along the laminating direction is generated in the lamination active portion. Here, electric field is applied in advance to the lamination active portion, and the lamination active portion is polarized before the actuator unit 221 is driven. By advancing the c-axis orientation to a certain degree in the lamination active portion before the actuator unit 221 is driven, the change in the c-axis orientation in the lamination active portion can be prevented even when the actuator unit 221 is used over a long period.

<Modifications>

Although preferred embodiments of the present invention were described above, the present invention is not limited to the above-described embodiments, and various modifications are possible within the scope of the claims.

For example, the change of the characteristic occurring in the piezoelectric film 41 in the above-described embodiment occurs because of the presence of the region in the piezoelectric film 41 that is not sandwiched by the individual electrodes 35 and common electrode 34. Thus, the above-described change of the characteristic will occur even in the case when the piezoelectric film 41 does not have a size sufficient to extend and cover the pressure chamber 10, for example, has a size such that it is contained in the region facing the pressure chamber 10. Therefore, the present invention can be also employed when the piezoelectric film 41 is formed to a size such that it is contained in the region facing the pressure chamber 10.

Furthermore, in the above-described embodiment, the case is explained where the peripheral signal is applied within the period other than the period in which the ink discharge signal is applied. The period in which the ink discharge signal is not applied is referred as non-discharge period. The non-discharge period preferably also includes, for example, a page feeding period and/or a line feeding period.

Furthermore, the common electrode 34 may be electrically connected to the printing control module 101 via a FPC. Thus, the controller 100 may change the common electrode 34 to electric potentials of various levels. As a result, various voltage signals can be also applied to the common electrode and a more complex voltage signal can be applied between the individual electrode 35 and common electrode 34 and/or between the peripheral electrode 37 and common electrode 33.

In the above-described embodiment, the ink discharge signal applied between the individual electrode 35 and common electrode 34 during the ink discharge operation had a waveform shown in FIG. 9(*a*). As shown in FIG. 9(*a*), at the beginning time t1 and at the ending time t2 of the ink discharge signal, voltage applied between the individual electrode 35 and the common electrode 34 is set to the predetermined voltage V0. In the period Tb which is a period between time t1 and time t2, voltage applied between the individual electrode 35 and the common electrode 34 is set to zero voltage. The voltage in the period Tb may set other than zero voltage. The voltage in the period Tb may set lower than the predetermined voltage V0. If the lower voltage is applied during the period Tb, the volume of the pressure chamber during the period Tb becomes larger than the volume of the pressure chamber during the period in which the predetermined voltage is applied. Thus, if the lower voltage is applied during the period Tb, the ink discharge operation by the above-described "fill before fire" method can be realized.

The above-described change of the piezoelectric characteristic can occur in the piezoelectric actuator even when the lower voltage is applied during the period Tb. In such case, too, employing the present invention makes it possible to provide an inkjet printer in which the change of ink discharge characteristic can be prevented even in long-term use.

What is claimed is:

1. An inkjet printer comprising:

a pressure chamber communicating with a nozzle, the pressure chamber capable of being filled with ink;

a piezoelectric actuator having a piezoelectric film, a first electrode, a second electrode, and a third electrode; and, a controller to apply voltage between the first electrode and the second electrode and between the third electrode and the second electrode independently;

wherein:

the piezoelectric actuator forms a portion of a wall defining the pressure chamber;

the piezoelectric film of the piezoelectric actuator extends along the portion of the wall;

the first electrode is attached on one surface of the piezoelectric film within a first region overlapping with the portion of the wall;

the second electrode is attached on the other surface of the piezoelectric film extending over the first region overlapping with the first electrode;

the third electrode is attached on the one surface of the piezoelectric film, adjacent to the first electrode without contacting the first electrode, at a second region overlapping with a portion of the second electrode, the second region of the piezoelectric film being polarized in a same direction as a polarization direction of the first region of the piezoelectric film;

the piezoelectric actuator deforms so as to project toward the pressure chamber and to decrease a volume of the pressure chamber while the controller applies voltage between the first electrode and the second electrode;

the controller applies an ink discharge signal between the first electrode and the second electrode, the ink discharge signal comprising an advanced voltage change from a predetermined voltage to a lower voltage and a subsequent voltage change from the lower voltage to the predetermined voltage wherein the combination of the volume increase and the subsequent volume decrease of the pressure chamber due to the ink discharge signal causes ink to discharge from the nozzle;

the controller further applies a peripheral signal between the second electrode and the third electrode; and the controller applies the predetermined voltage with a same polarity as the ink discharge signal between the second electrode and the third electrode as the peripheral signal.

2. An inkjet printer as in claim 1, wherein the piezoelectric actuator further has a diaphragm, the diaphragm sandwiches the second electrode with the piezoelectric film and the diaphragm being positioned between the piezoelectric film and the pressure chamber.

3. An inkjet printer as in claim 1, wherein the lower voltage is substantially equal to zero voltage.

4. An inkjet printer as in claim 1, wherein the controller applies the peripheral signal in an interval of the two sequential ink discharge signals.

5. An inkjet printer as in claim 1, wherein the controller applies the peripheral signal within a period that the ink discharge signal is applied, the peripheral signal has a waveform so as to enhance efficiency of the volume change of the pressure chamber caused by the ink discharge signal.

6. An inkjet printer as in claim 1, wherein one continuous piezoelectric film extends over the pressure chamber.

7. An inkjet printer as in claim 1, wherein the third electrode has a hole, and the first electrode is positioned within the hole.

8. An inkjet printer as in claim 1, wherein the first electrode and the third electrode have substantially the same thickness.

9. An inkjet printer as in claim 1, wherein the controller applies a constant voltage between the second electrode and the third electrode as the peripheral signal.

10. An inkjet printer as in claim 1, wherein the second electrode is held at a constant electric potential.

11. An inkjet printer as in claim 1 further comprising:

a counter that counts a number of ink discharges, wherein the controller applies the peripheral signal when the number of ink discharges counted by the counter reaches a predetermined number.

12. An inkjet printer comprising:

a pressure chamber communicating with a nozzle, the pressure chamber capable of being filled with ink;

a piezoelectric actuator having a piezoelectric film, a first electrode, a second electrode, and a third electrode; and, a controller to apply voltage between the first electrode and the second electrode and between the third electrode and the second electrode independently;

wherein:

the piezoelectric actuator forms a portion of a wall defining the pressure chamber;

the piezoelectric film of the piezoelectric actuator extends along the portion of the wall;

the first electrode is attached on one surface of the piezoelectric film within a region overlapping with the portion of the wall;

the second electrode is attached on the other surface of the piezoelectric film extending over a region overlapping with the first electrode;

the third electrode is attached on the one surface of the piezoelectric film, adjacent to the first electrode without contacting the first electrode, at a second region overlapping with a portion of the second electrode;

the piezoelectric actuator deforms so as to project toward the pressure chamber and to decrease a volume of the pressure chamber while the controller applies voltage between the first electrode and the second electrode;

the controller applies an ink discharge signal between the first electrode and the second electrode, the ink discharge signal comprising an advanced voltage change from a predetermined voltage to a lower voltage and a subsequent voltage change from the lower voltage to the predetermined voltage wherein the combination of the volume increase and the subsequent volume decrease of the pressure chamber due to the ink discharge signal causes ink to discharge from the nozzle;

the controller further applies a peripheral signal between the second electrode and the third electrode;

the controller applies the predetermined voltage between the second electrode and the third electrode as the peripheral signal; and the peripheral signal has a waveform repeating the predetermined voltage and zero voltage cyclically.

* * * * *